US010777174B2

(12) United States Patent
Barnes

(10) Patent No.: US 10,777,174 B2
(45) Date of Patent: Sep. 15, 2020

(54) VARIABLE PITCH IDIOPHONE AND METHOD OF PLAYING SAME

(71) Applicant: Jacob Barnes, Madison, WI (US)

(72) Inventor: Jacob Barnes, Madison, WI (US)

( * ) Notice: Subject to any disclaimer, the term of this patent is extended or adjusted under 35 U.S.C. 154(b) by 0 days.

(21) Appl. No.: 15/945,374

(22) Filed: Apr. 4, 2018

(65) Prior Publication Data

US 2018/0286362 A1 Oct. 4, 2018

Related U.S. Application Data

(60) Provisional application No. 62/481,459, filed on Apr. 4, 2017.

(51) Int. Cl.
*G10D 13/08* (2020.01)
*G10D 17/00* (2020.01)

(52) U.S. Cl.
CPC ..... *G10D 13/08* (2013.01); *G10D 17/00* (2013.01)

(58) Field of Classification Search
CPC ..... G10D 13/08; G10D 17/00
See application file for complete search history.

(56) References Cited

U.S. PATENT DOCUMENTS

| | | | |
|---|---|---|---|
| 2,546,452 | A | 3/1951 | Kmieliauskas |
| 3,590,680 | A | 7/1971 | Carnes et al. |
| 3,896,696 | A | 7/1975 | Waters |
| 3,924,560 | A | 12/1975 | Kaftan |
| 4,121,835 | A | 10/1978 | Garabedian |
| 5,610,350 | A | 3/1997 | Miller |
| 6,198,033 | B1 | 3/2001 | Lovelett |
| 7,473,835 | B2 | 1/2009 | Balma et al. |
| 7,781,653 | B2 | 8/2010 | Reynolds |
| 7,786,364 | B2 | 8/2010 | Natoli |
| 7,829,776 | B2 | 11/2010 | Shrock et al. |
| 7,888,568 | B2 | 2/2011 | Kashioka |
| 8,148,618 | B1 | 4/2012 | Vaden |
| 8,829,320 | B2 | 9/2014 | Tahour |
| 9,153,221 | B2 | 10/2015 | Ribner |

(Continued)

FOREIGN PATENT DOCUMENTS

| | | |
|---|---|---|
| DE | 4209311 | 4/1993 |
| FR | 2791460 | 3/1999 |

(Continued)

OTHER PUBLICATIONS

International Search Report and Written Opinion of the International Searching Authority dated Jun. 22, 2018, for Int'l. Appln. No. PCT/US2018/026066 filed Apr. 4, 2018, 7 pages.

(Continued)

*Primary Examiner* — Kimberly R Lockett
(74) *Attorney, Agent, or Firm* — Boardman & Clark LLP

(57) ABSTRACT

A first vessel provided in spaced nested relation to and at least partially around a second vessel or member, the first vessel having a bottom section coupled to a sidewall to form a liquid receiving receptacle open at an upper end of the sidewall. Further provided is liquid in the liquid receiving receptacle. The second vessel or member is moveable relative to the first vessel to displace and/or replace the liquid in the first vessel such that the first vessel can produce different pitches and/or tones as or after the liquid is displaced and/or replaced and the first vessel is struck, rubbed or otherwise vibrated.

13 Claims, 19 Drawing Sheets

(56) References Cited

U.S. PATENT DOCUMENTS

| | | | | |
|---|---|---|---|---|
| 9,208,758 | B2 | 12/2015 | Brockman | |
| 2005/0160898 | A1 | 7/2005 | Shrock et al. | |
| 2005/0211060 | A1* | 9/2005 | Carter | G10K 1/07 84/410 |
| 2007/0131086 | A1 | 6/2007 | Ischer | |
| 2012/0011990 | A1 | 1/2012 | Mann | |
| 2014/0174277 | A1* | 6/2014 | Mann | G10D 17/00 84/331 |
| 2015/0348521 | A1 | 12/2015 | Nigro | |
| 2016/0322037 | A1 | 11/2016 | Chervitz | |

FOREIGN PATENT DOCUMENTS

| | | |
|---|---|---|
| GB | 1283818 | 8/1972 |
| WO | 9613028 | 10/1995 |

OTHER PUBLICATIONS

Gourd Water Drum, Georgia Gourd Guy, Georgiagourdguy.com, https://web.archive.org/web/20130405014915/http://georgiagourdguy.com/gourd_water_drum.html.

About the Waterphone, Waters, Rayme; Waterphone™ Online Waterphone.digiprolocal.com, 2015, http://waterphone.digiprolocal.com/.

"Tan Dun presenta Water Concerto video completo," Youtube, youtube.com, Nov. 14, 2013, https://www.youtube.com/watch?v=3QllpdSec8A.

Iroquois Water Drum, Native Drums, native-drums.ca, Dec. 12, 2012, https://web.archive.org/web/20121212055819/http://www.native-drums.ca/index.php/Drums/Water_Drum.

* cited by examiner

VARIABLE PITCH IDIOPHONE AND METHOD OF PLAYING SAME

CROSS-REFERENCE TO RELATED APPLICATIONS

This application claims priority to U.S. Provisional Patent Application Ser. No. 62/481,459, filed Apr. 4, 2017, which is incorporated in its entirety herein by reference.

FIELD

The present inventions relate to the field of musical instruments. The present inventions more specifically relate to the field of percussion, and idiophones that are configured or adapted to produce a variety of tones and/or pitches, and methods for playing same.

BACKGROUND

Referring to FIG. 1, known musical instruments fall into various categories or families. For example, there are four known main categories of musical instruments: aerophones (wind), chordophones (strings), electrophones, and percussion. There are two known categories of percussion musical instruments: idiophones and membranophones. Further, there currently are two known categories of idiophones: pitched idiophones and unpitched idiophones. Known pitched idiophones typically resonate at a specific pitch or tone when caused to vibrate (e.g., by striking, scraping, rubbing or plucking.) As such, known pitched idiophones emit a single tone or pitch and therefore require vibration of a plurality of pitched idiophones simultaneously to achieve a chord or note combination. Musicians hoping to incorporate known pitched idiophones into musical compositions are often limited by the number of idiophones that can be vibrated or caused to vibrate simultaneously. Further, if a player desires to play separate types of idiophonic instruments, individual idiophones are required for each separate type. Typical idiophones have not been configured or adapted to produce a variable tone and/or pitch (e.g., with a single strike, scrape, rub, or pluck.)

In music, a glissando or portamento is a glide from one pitch to another. Known idiophones cannot glide continuously from one pitch to another (i.e., without the discrete tones being clearly audible). It is also difficult to bend notes produced by known idiophones.

Idiophones sounding in the lower registers (e.g., bass and baritone) are not also currently widely available. This may be due to size and storage requirements and purchasing and maintenance costs.

SUMMARY

Accordingly, there is a need for a variable pitch and/or tone idiophone. There is also a need for an idiophone that is able to sound in the lower ranges. There is also a need for an idiophone that can glide continuously from one pitch to another (i.e., without the discrete tones being clearly audible). There is also a need for an idiophone that is capable of bending notes.

It would be desirable to provide an idiophone or the like of a type disclosed in the present application that includes any one or more of these or other advantageous features:

An idiophone that is configured or adapted to play variable pitches and/or tones, or a series of vessels arranged to produce such tones and/or pitches, with a single musical instrument and/or a single strike, scrape, rub or pluck;

An idiophone that can sound in the lower registers (e.g., bass and/or baritone), including one that can do so without unreasonable size or storage requirements, or purchasing and maintenance costs;

An idiophone that can glide continuously from one pitch to another; and/or

An idiophone that is capable of bending notes.

Other advantages and/or advantageous features will become apparent to those skilled in the art, once the disclosure has been more fully shown or described. Such outlining of advantageous features is not to be construed as a limitation of applicant's disclosure but are merely aimed to suggest some of the many benefits that may be realized by the apparatus and method of the present application and with its many embodiments.

Accordingly, a variable pitch and/or tone idiophone, and method for playing same are provided.

In various examples of embodiments, the variable pitch and/or tone idiophone or instrument comprises: a first vessel having a bottom section coupled to a sidewall to form a liquid receiving receptacle open at an upper end of the sidewall; and a second member provided in the liquid receiving receptacle of the first vessel in a spaced nested relation to the first vessel; whereby the first vessel or the second member make a sound of a first pitch or tone when struck, rubbed or vibrated; whereby the second member is moveable relative to the first vessel to displace and/or replace liquid in the liquid receiving receptacle of the first vessel such that the first vessel or second member makes a sound of a second pitch or tone when struck, rubbed or vibrated as the liquid therein is displaced or replaced by movement of the second member relative to the first vessel.

In various example embodiments, the method of playing the instrument comprises: moving a member provided in a liquid retained in a liquid receiving receptacle of a first vessel to displace and/or replace the liquid in the liquid receiving receptacle of the first vessel such that the first vessel makes sounds of different or varying pitches or tones when struck, rubbed or vibrated as the fluid is displaced or replaced in the first vessel.

In various example embodiments, the variable pitch and/or tone idiophone or instrument comprises: a first vessel having a bottom section coupled to a sidewall to form a liquid receiving receptacle open at an upper end of the sidewall; and a second member provided in the liquid receiving receptacle of the first vessel in a spaced nested relation to the first vessel; whereby the second member is configured to create one or more electromagnetic fields to displace and/or replace magnetic ferrofluid in the liquid receiving receptacle of the first vessel such that the first vessel makes sounds of different or varying pitches or tones when struck, rubbed or vibrated as the magnetic ferrofluid therein is displaced or replaced.

BRIEF DESCRIPTION OF DRAWINGS

Various examples of embodiments of the systems, devices, and methods according to this invention will be described in detail, with reference to the following figures, wherein.

Figure 3:
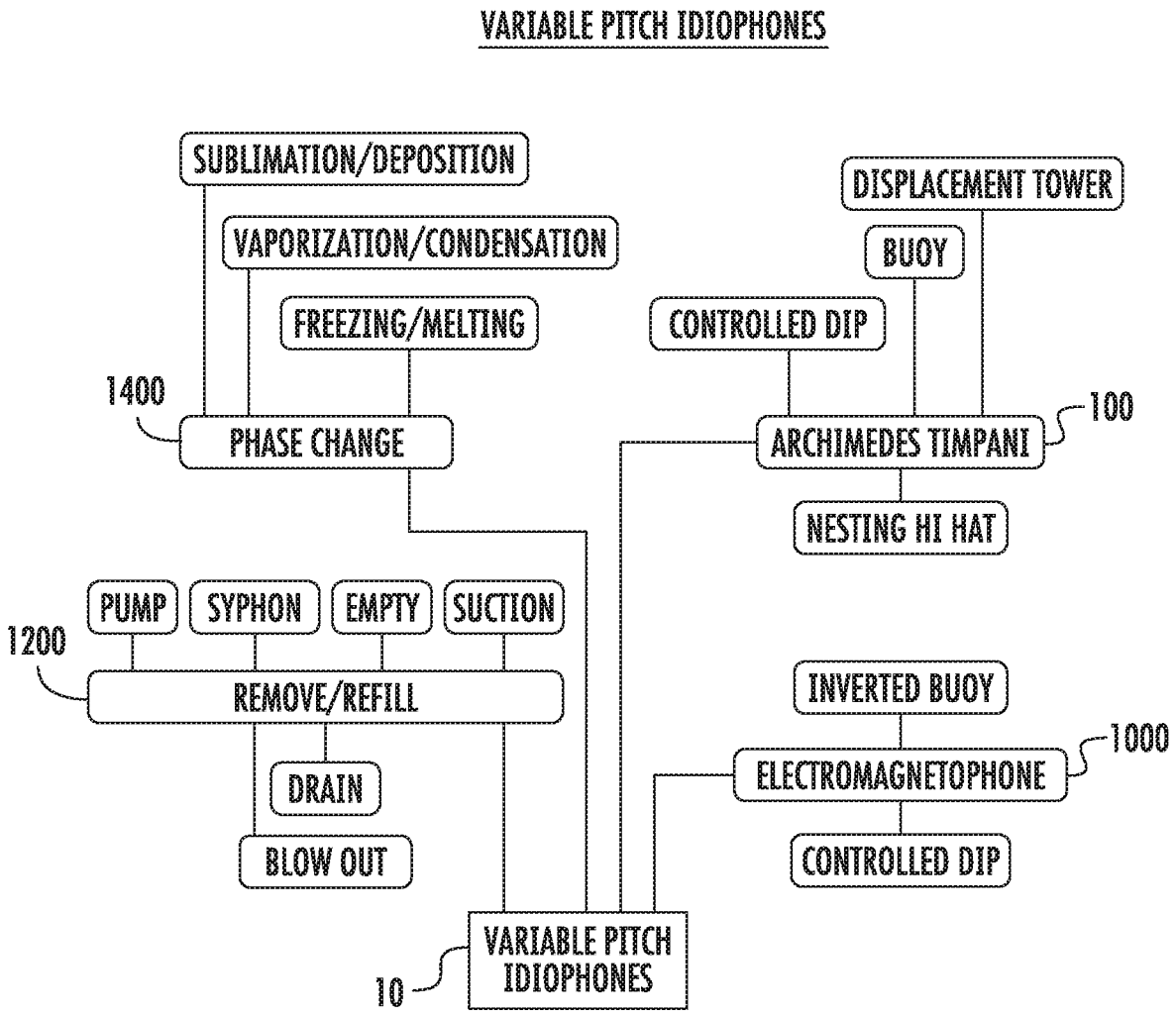
Figure 4:
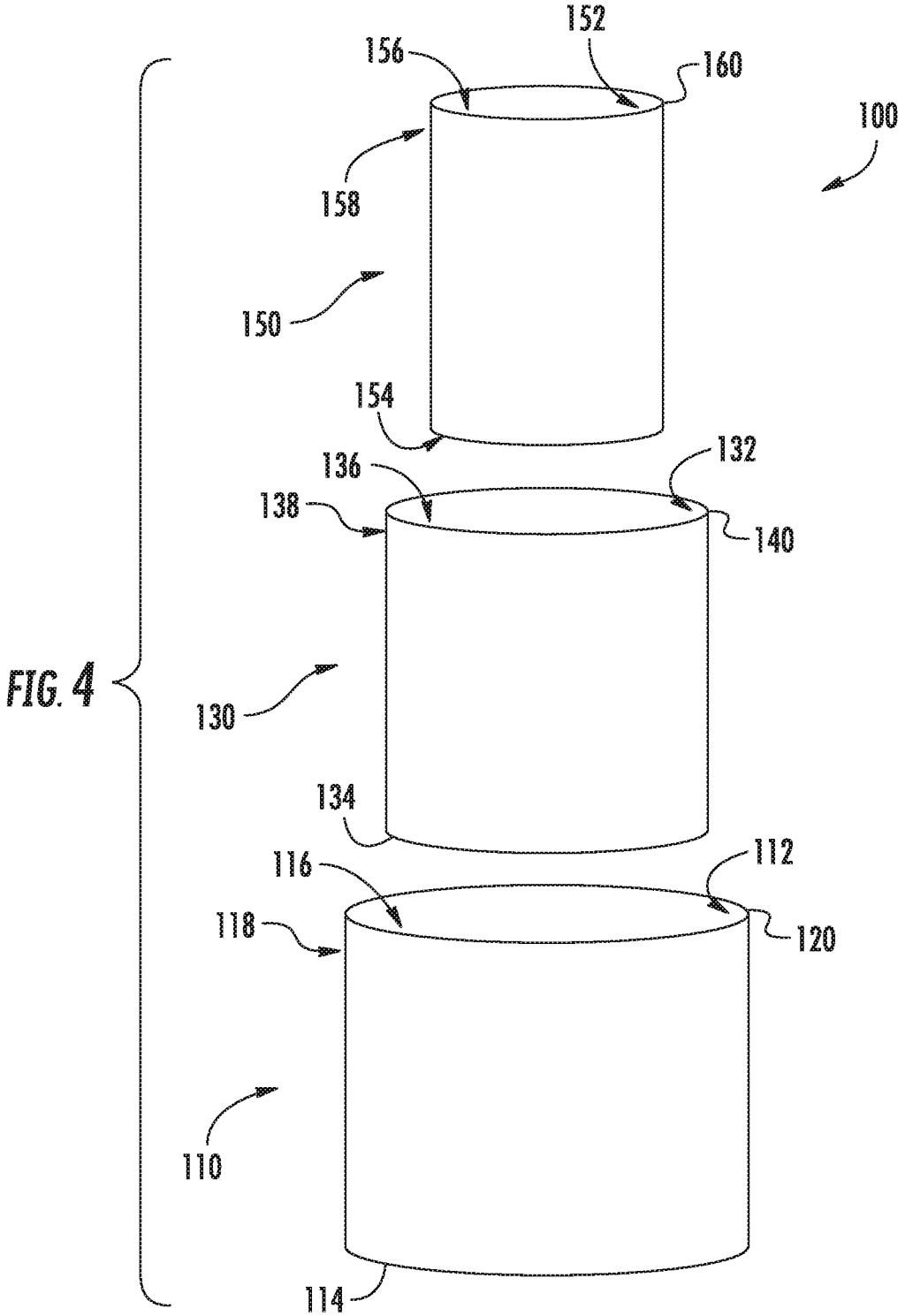
Figure 7:
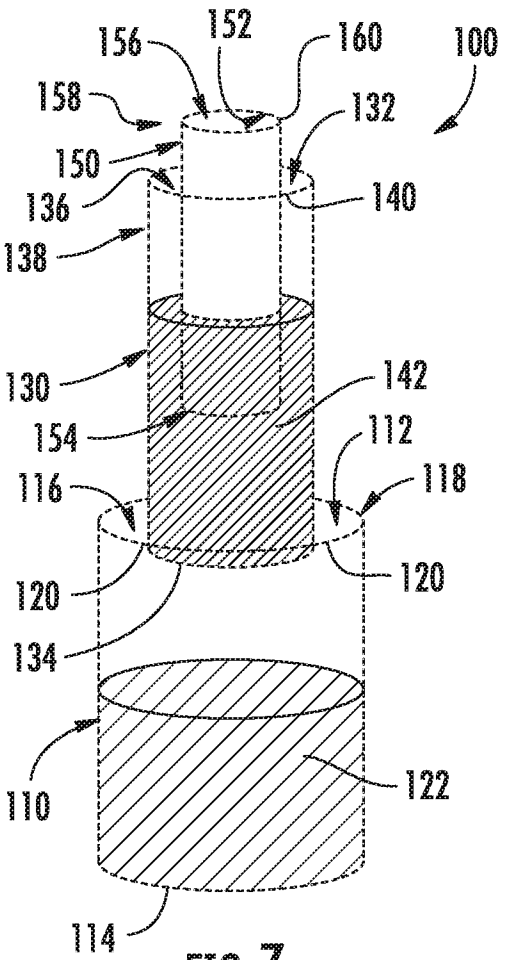
Figure 6:
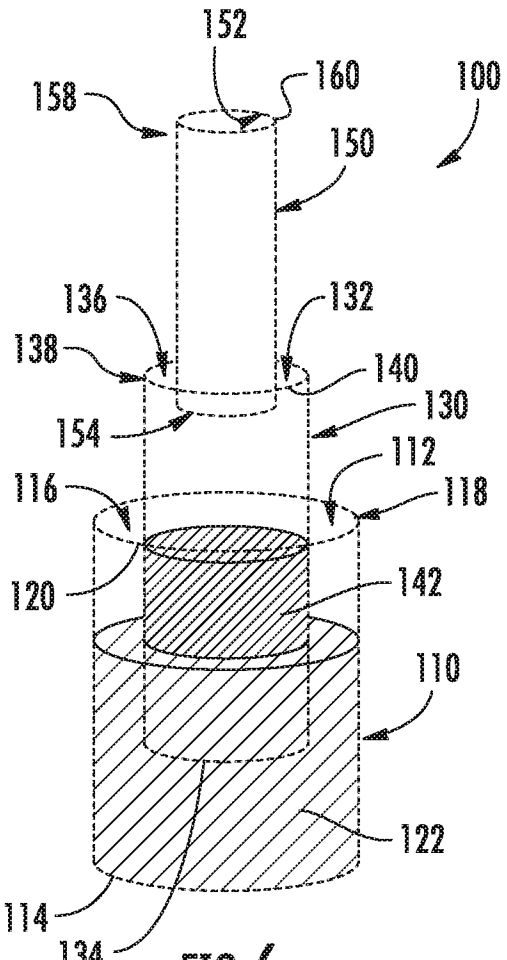
Figure 5:
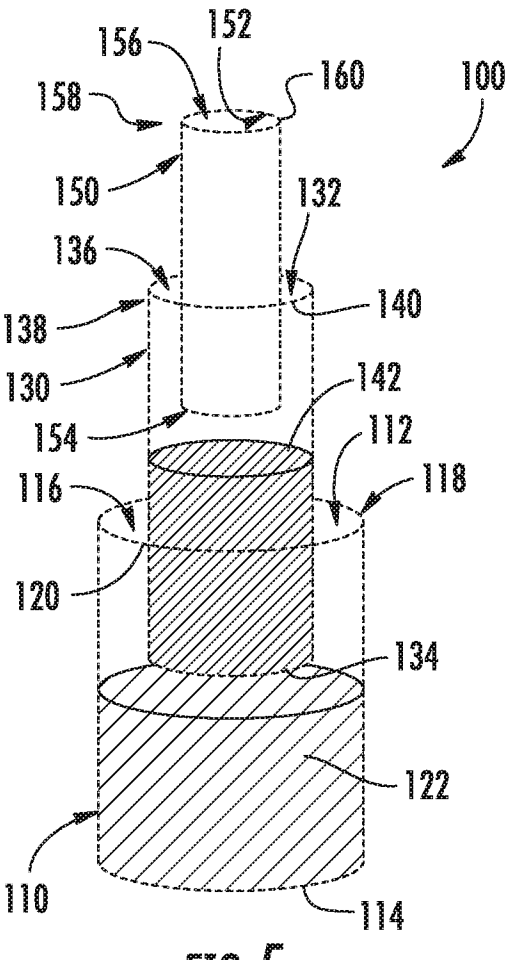
Figure 8:
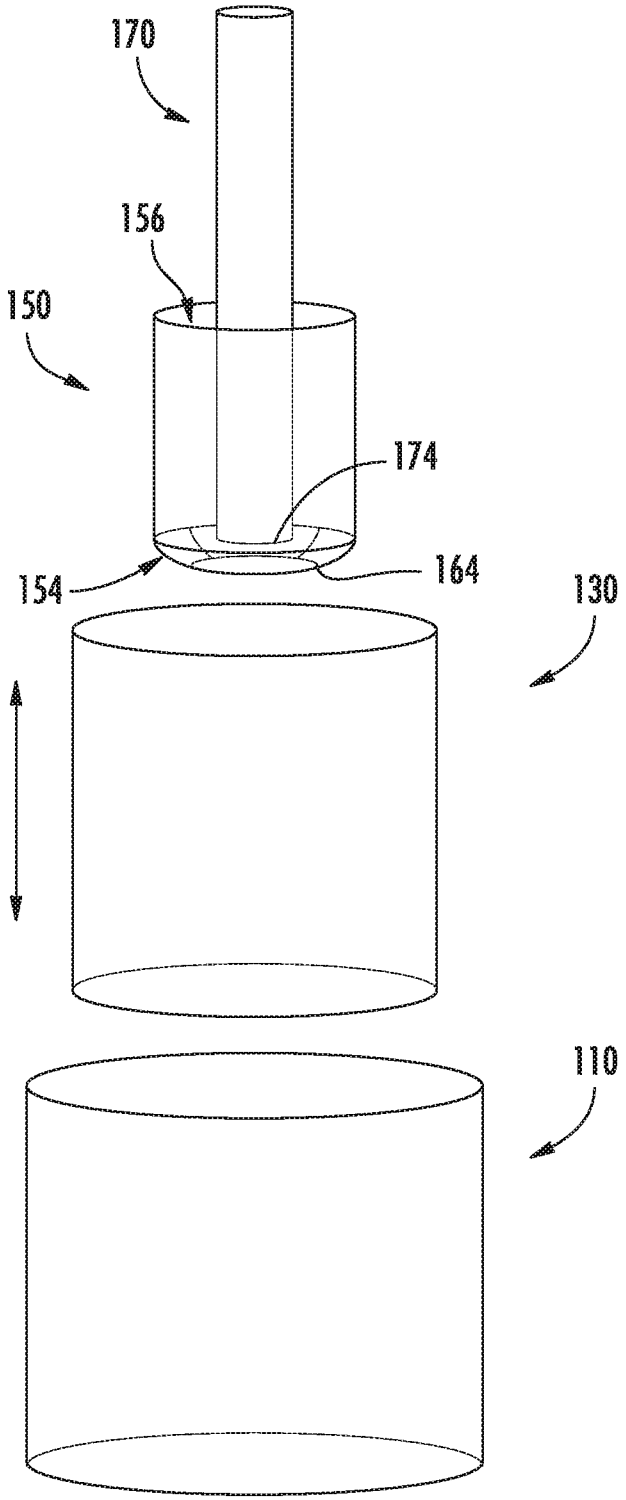
Figure 9:
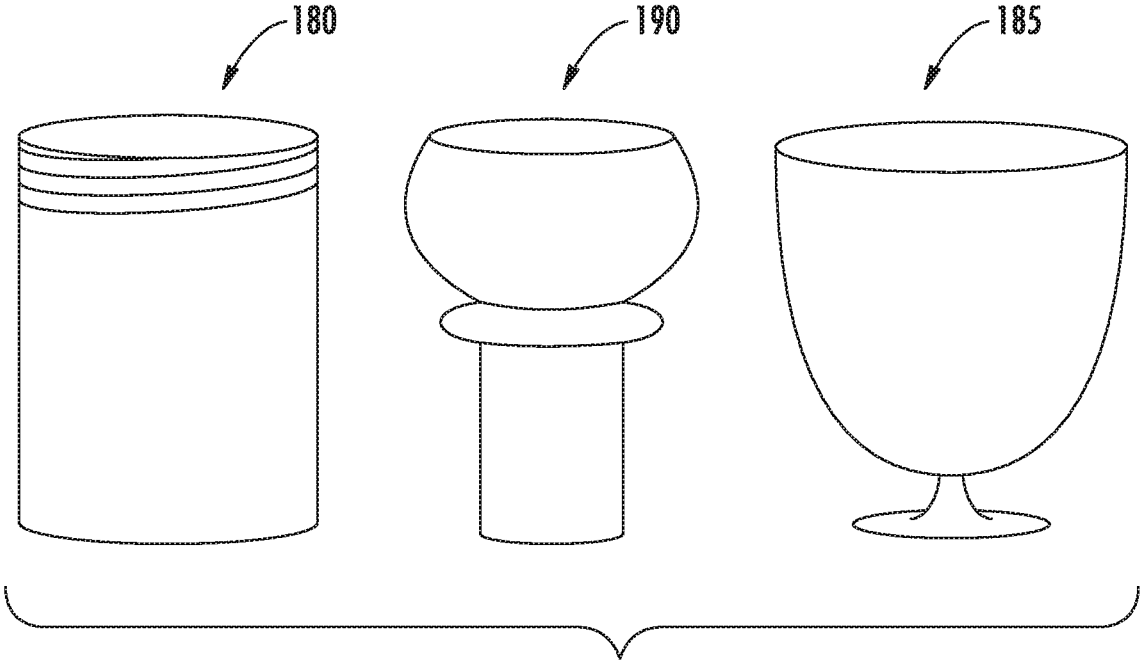

FIG. 3 illustrates a more detailed example of a classification or taxonomy of variable pitch and/or tone idiophones, according to one or more examples of embodiments;

FIG. 4 illustrates a perspective view of components of a variable pitch and/or tone idiophone, according to various examples of embodiments;

FIG. 5 illustrates a perspective view of components of a variable pitch and/or tone idiophone partially filled with a liquid, according to various examples of embodiments;

FIG. 6 illustrates a perspective view of components of a variable pitch and/or tone idiophone partially filled with a liquid, according to various examples of embodiments;

FIG. 7 illustrates a perspective view of components of a variable pitch and/or tone idiophone partially filled with a liquid, according to various examples of embodiments;

FIG. 8 illustrates a side perspective view of a set of vessels utilized in connection a variable pitch and/or tone idiophone, according to one or more examples of embodiments;

FIG. 9 illustrates various vessel shapes and characteristics that may be utilized in connection with a variable pitch and/or tone idiophone, according to various examples of embodiments.

Figure 10:
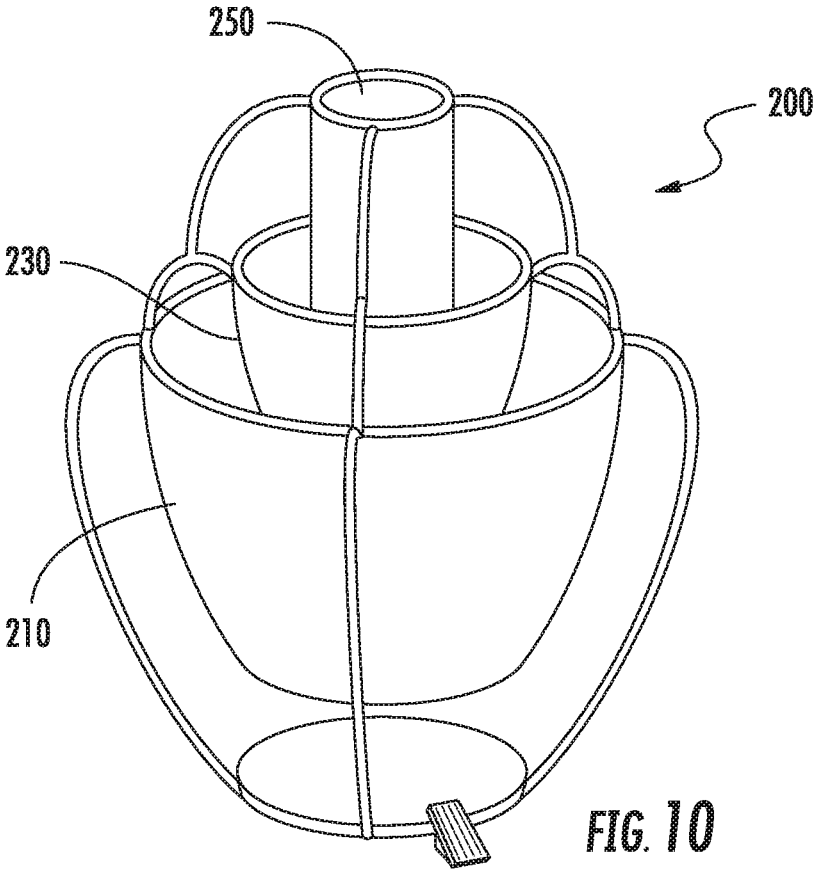
Figure 11:
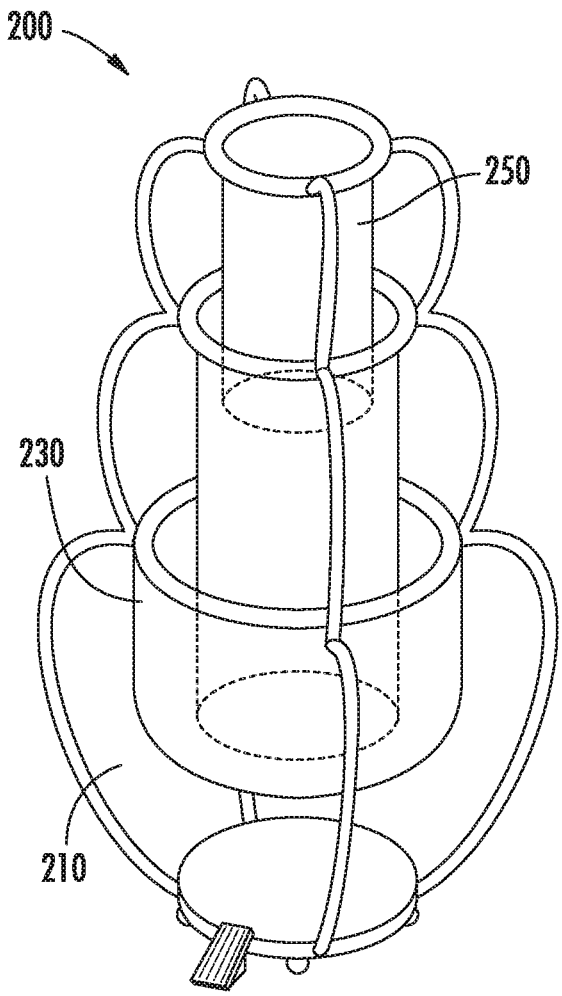
Figure 12:
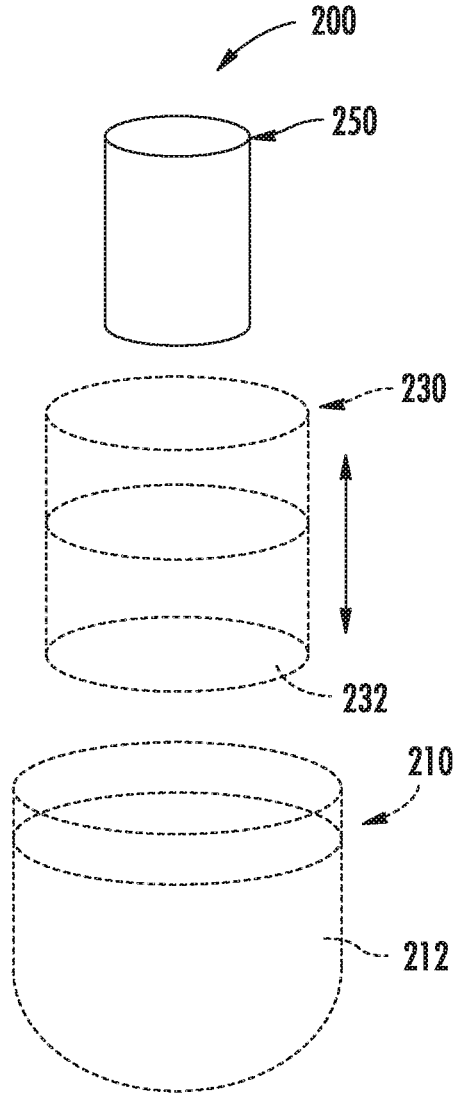
Figure 13:
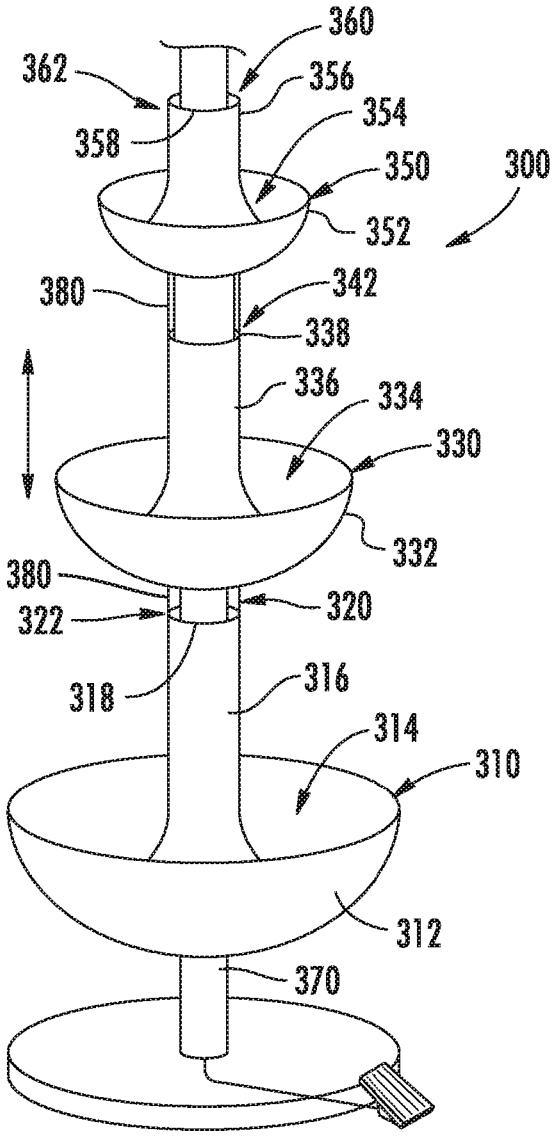
Figure 14:
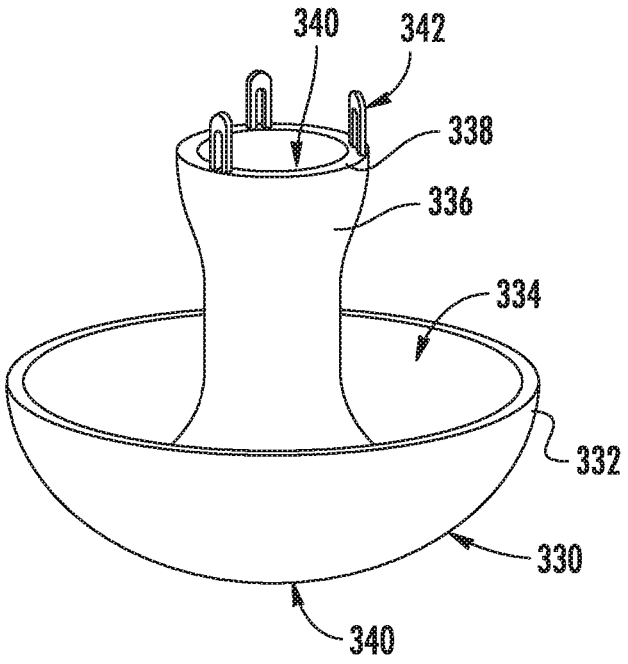
Figure 15:
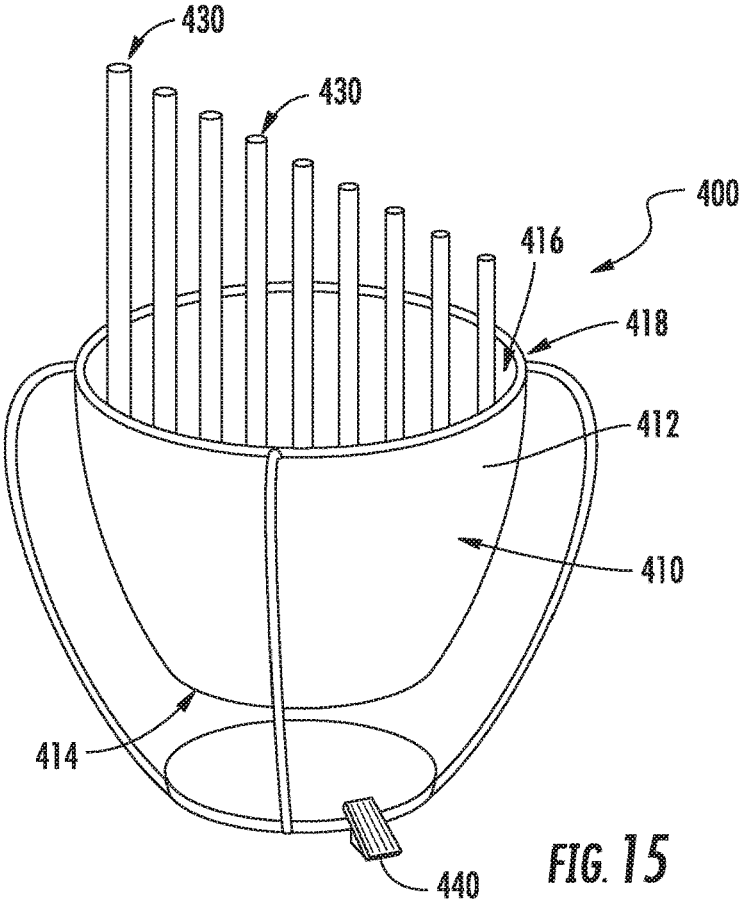
Figure 16:
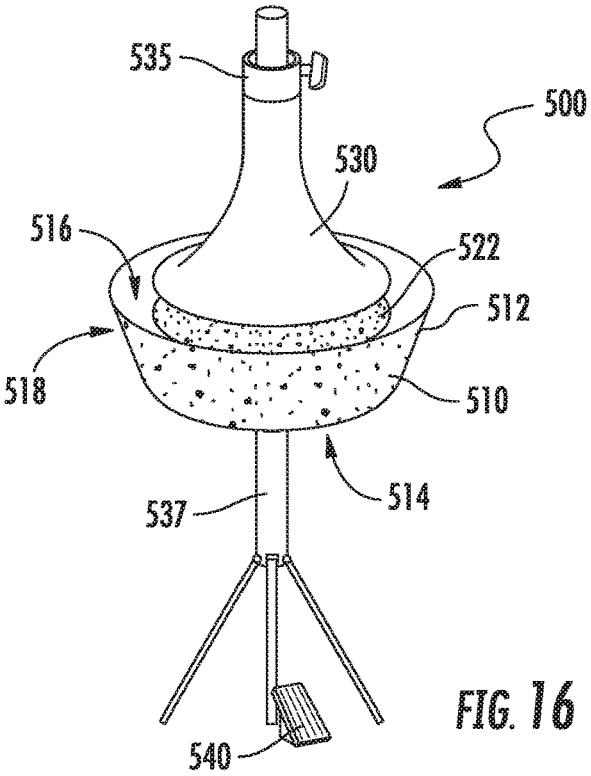
Figure 17:
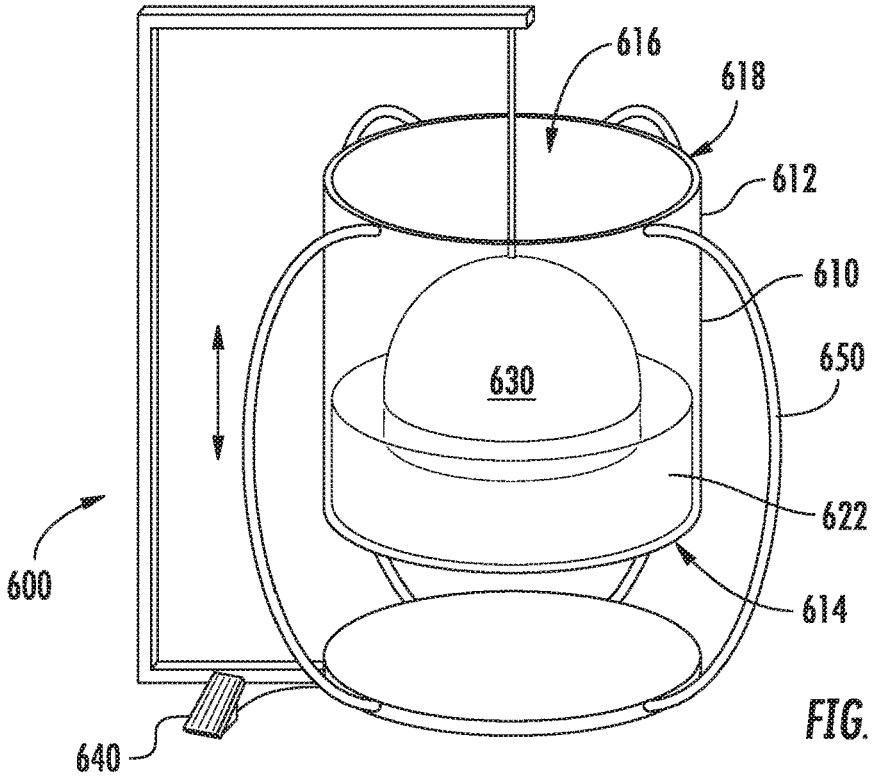
Figure 18:
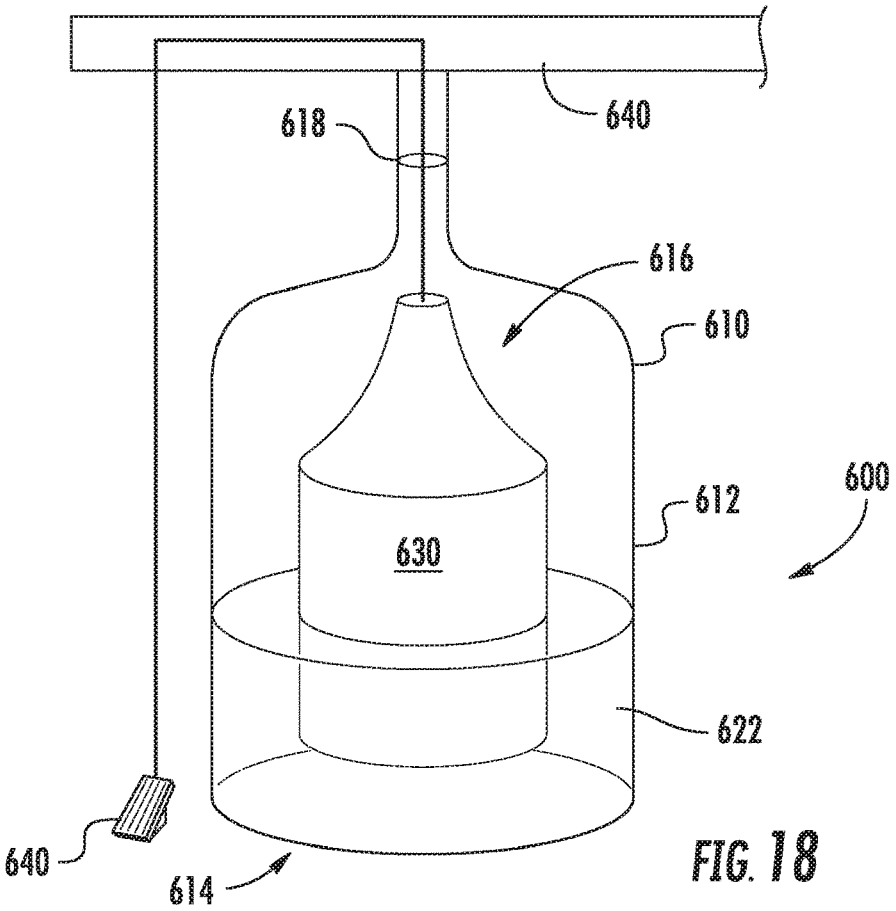
Figure 19:
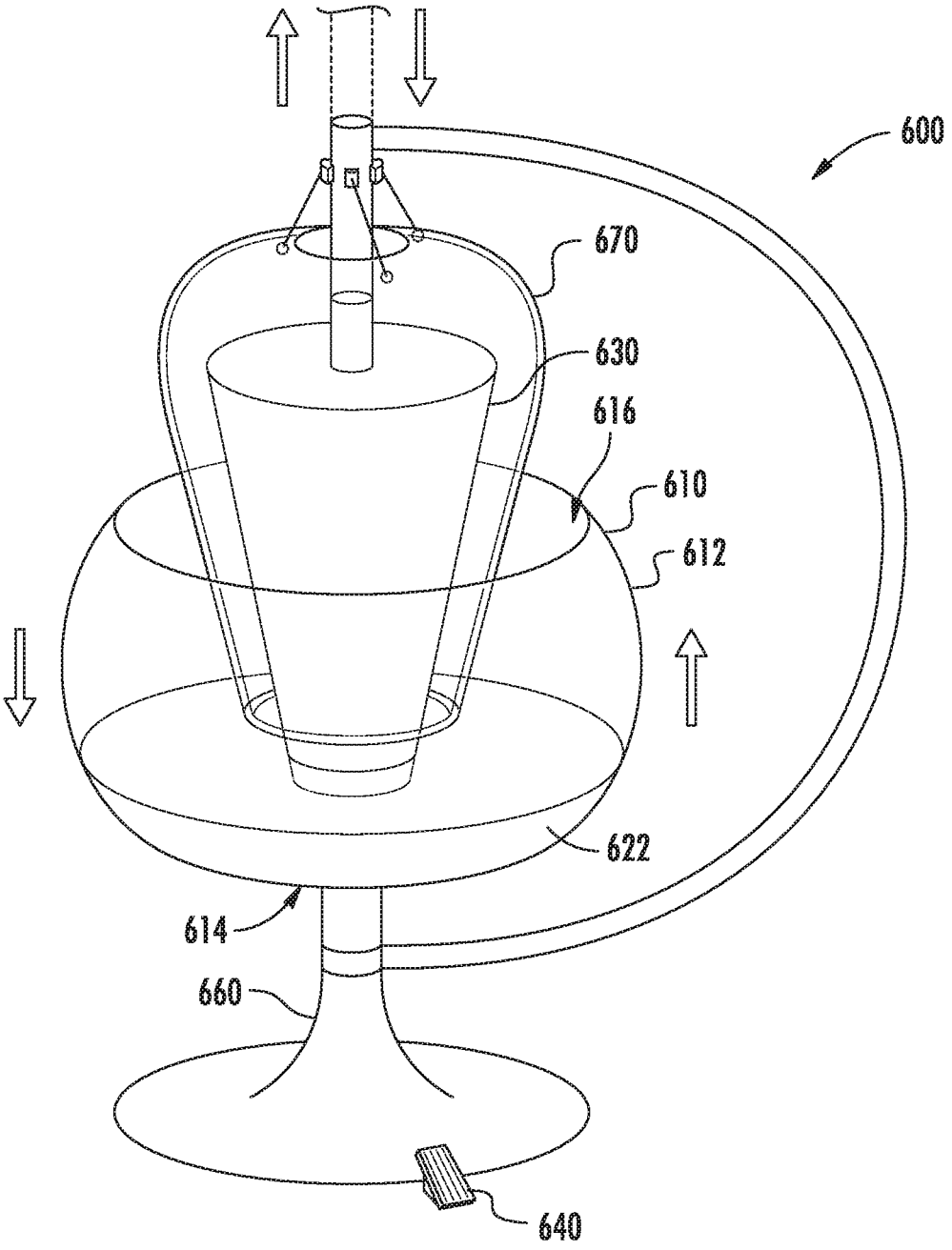
Figure 20:
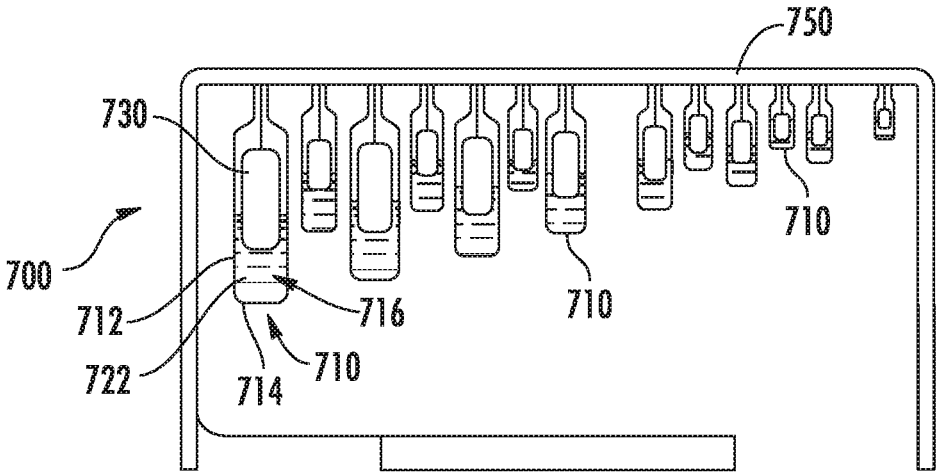
Figure 21:
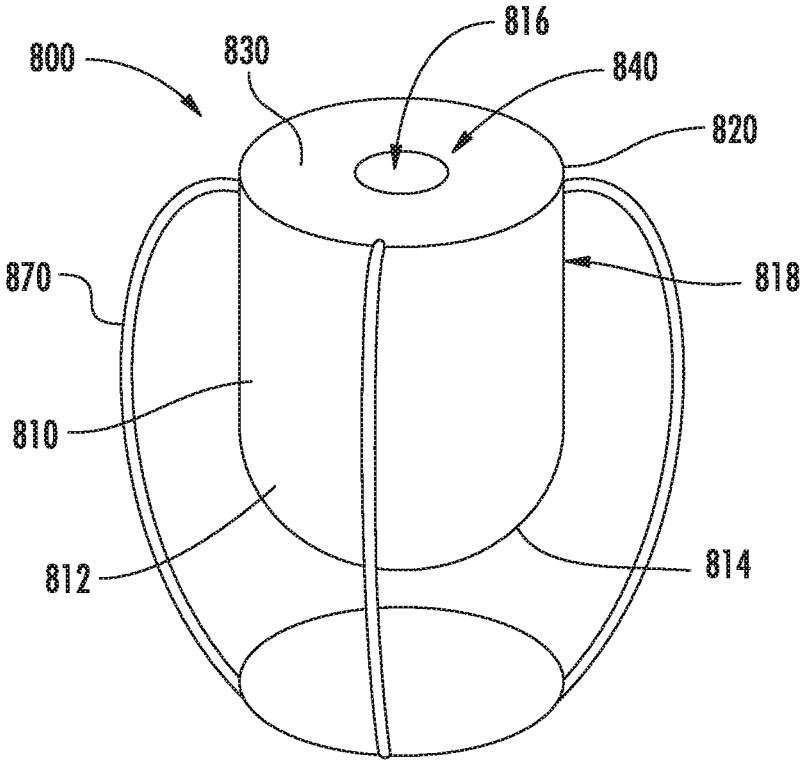
Figure 22:
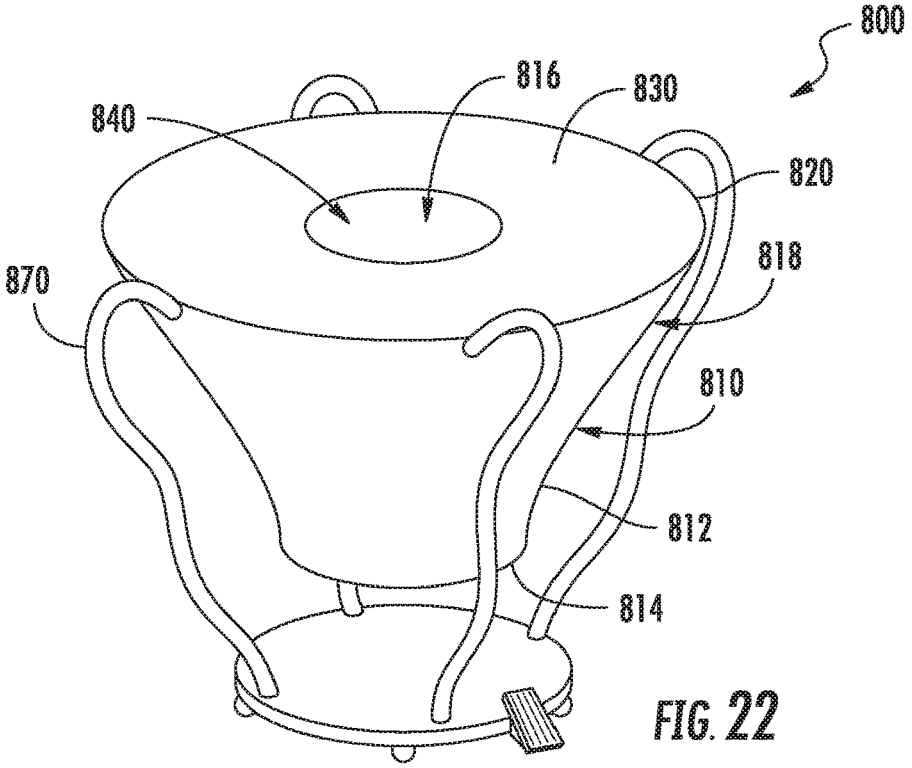
Figure 23:
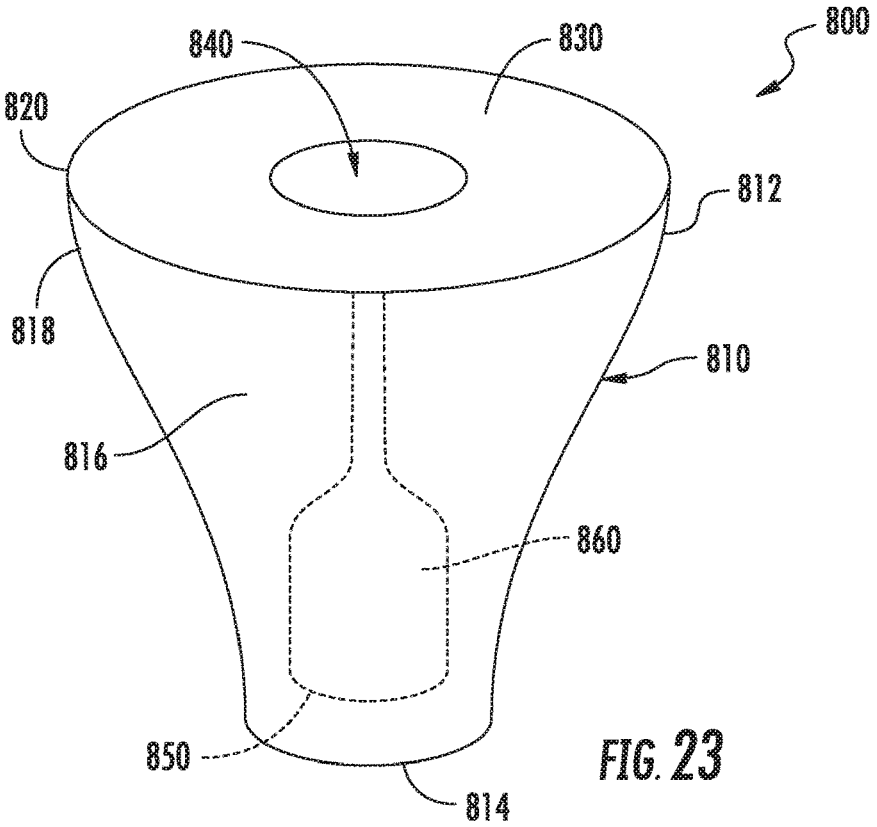
Figure 24:
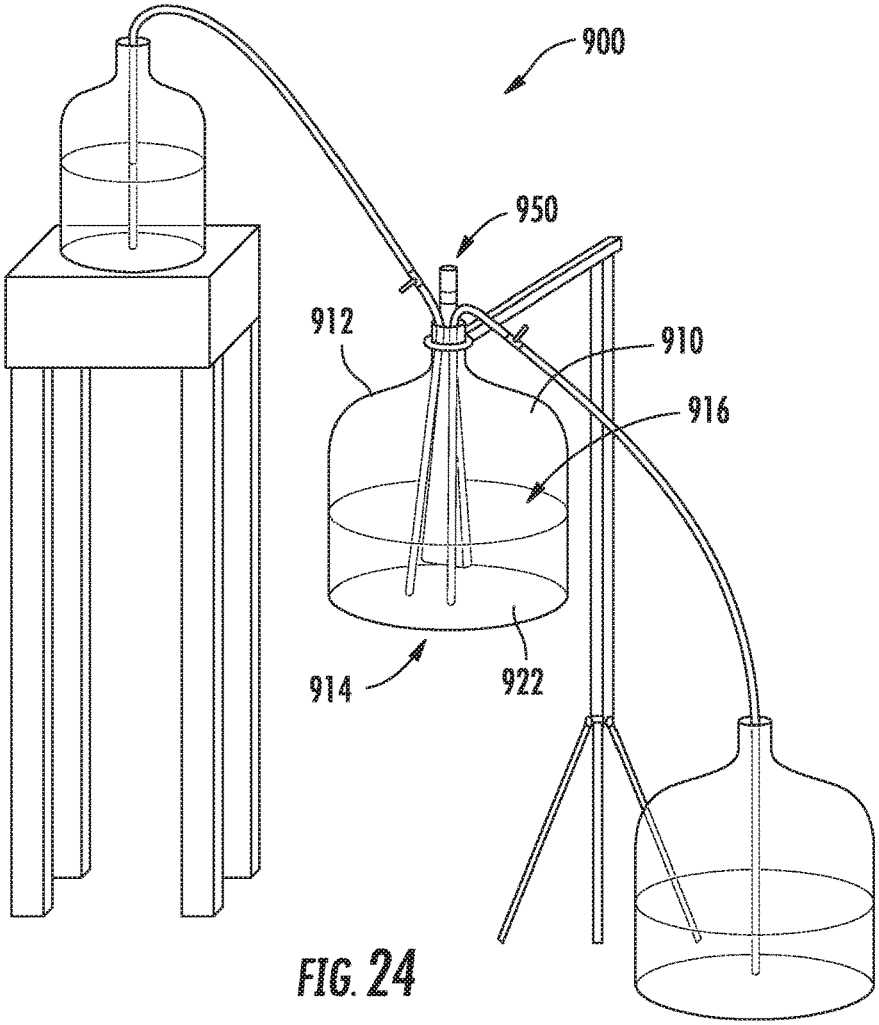
Figure 25:
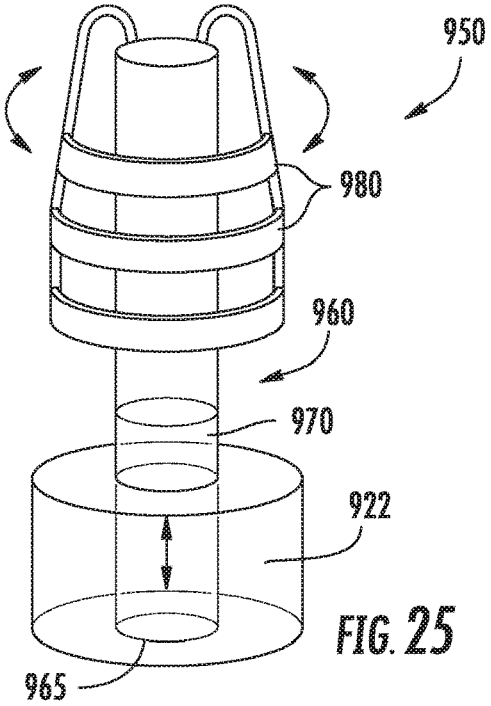
Figure 26:
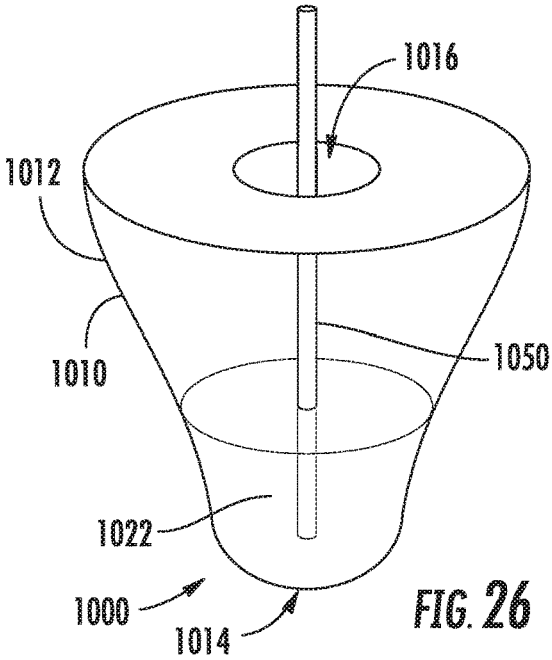
Figure 27:
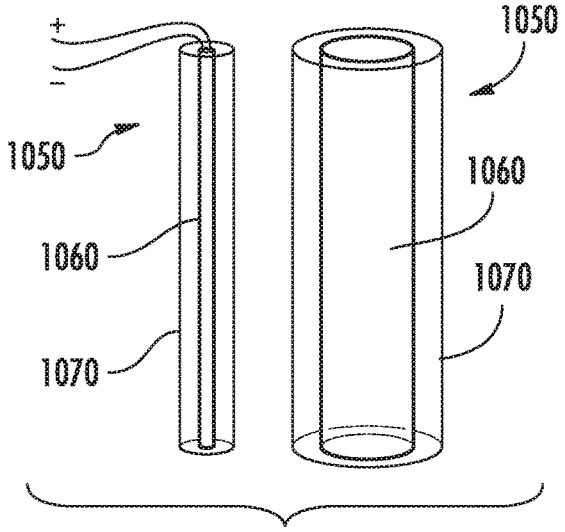
Figure 28A:
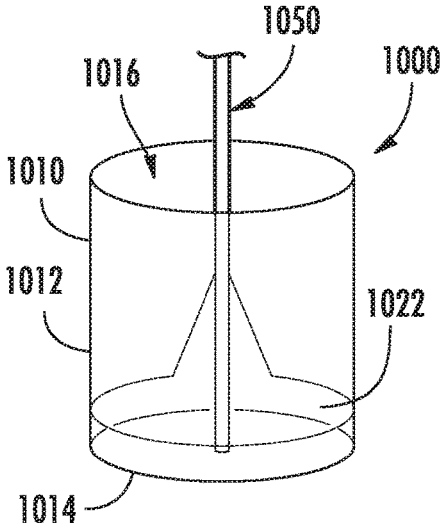
Figure 28B:
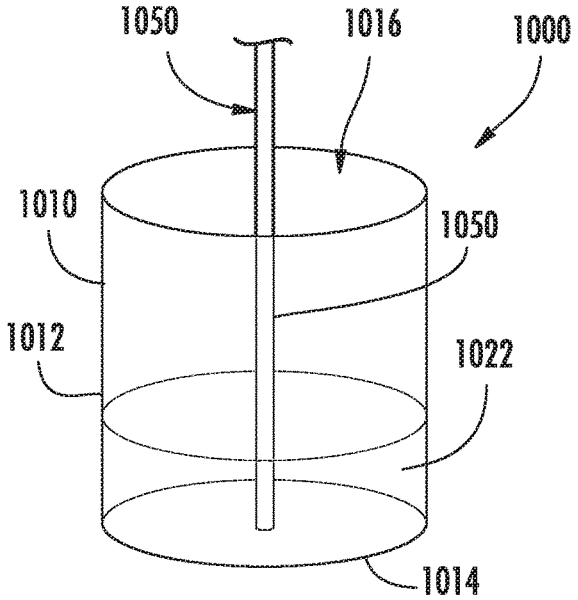
Figure 28C:
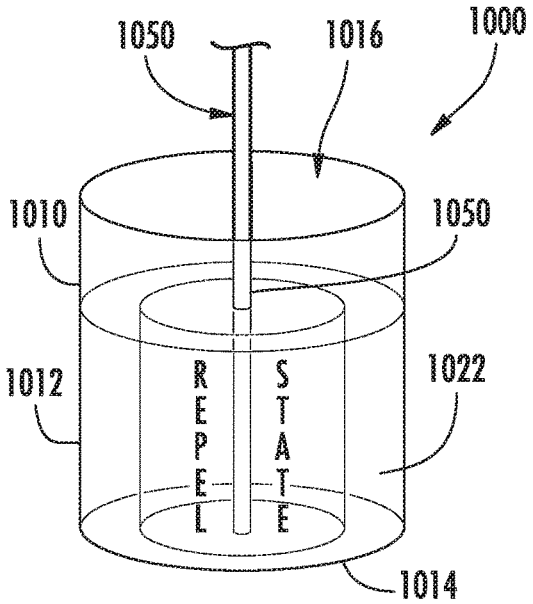
Figure 29A:
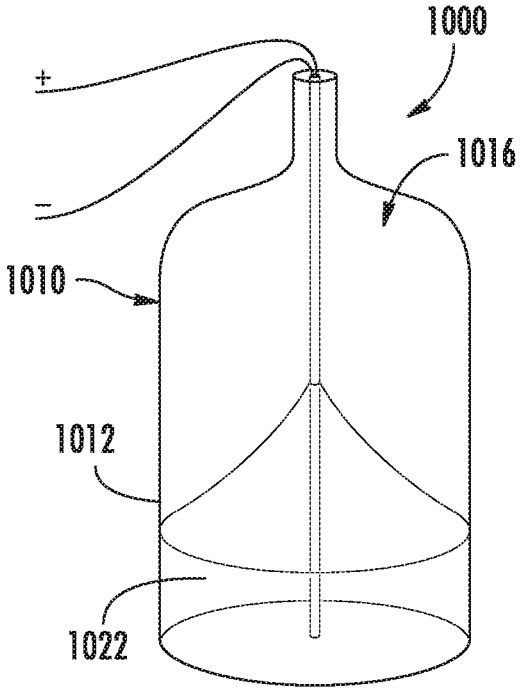
Figure 29B:
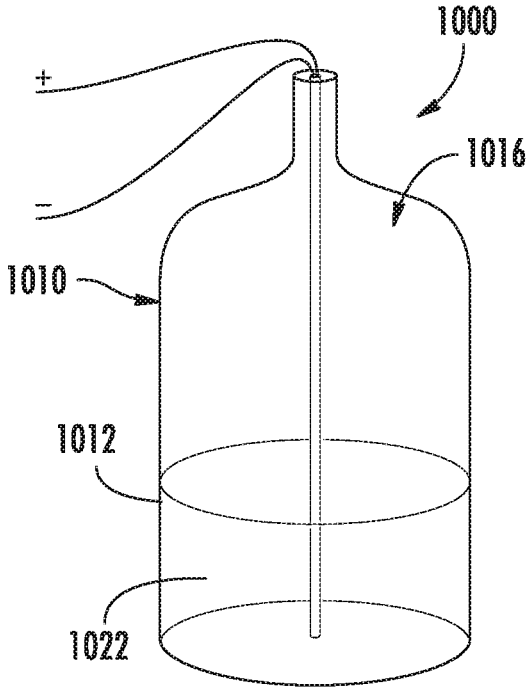
Figure 29C:
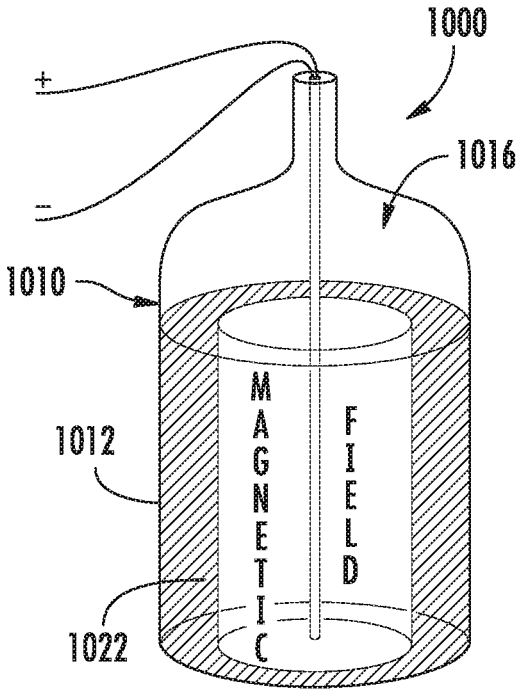
Figure 30:
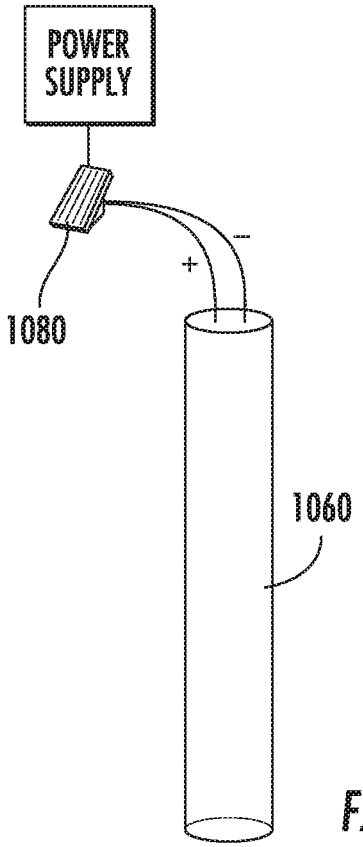
Figure 31:
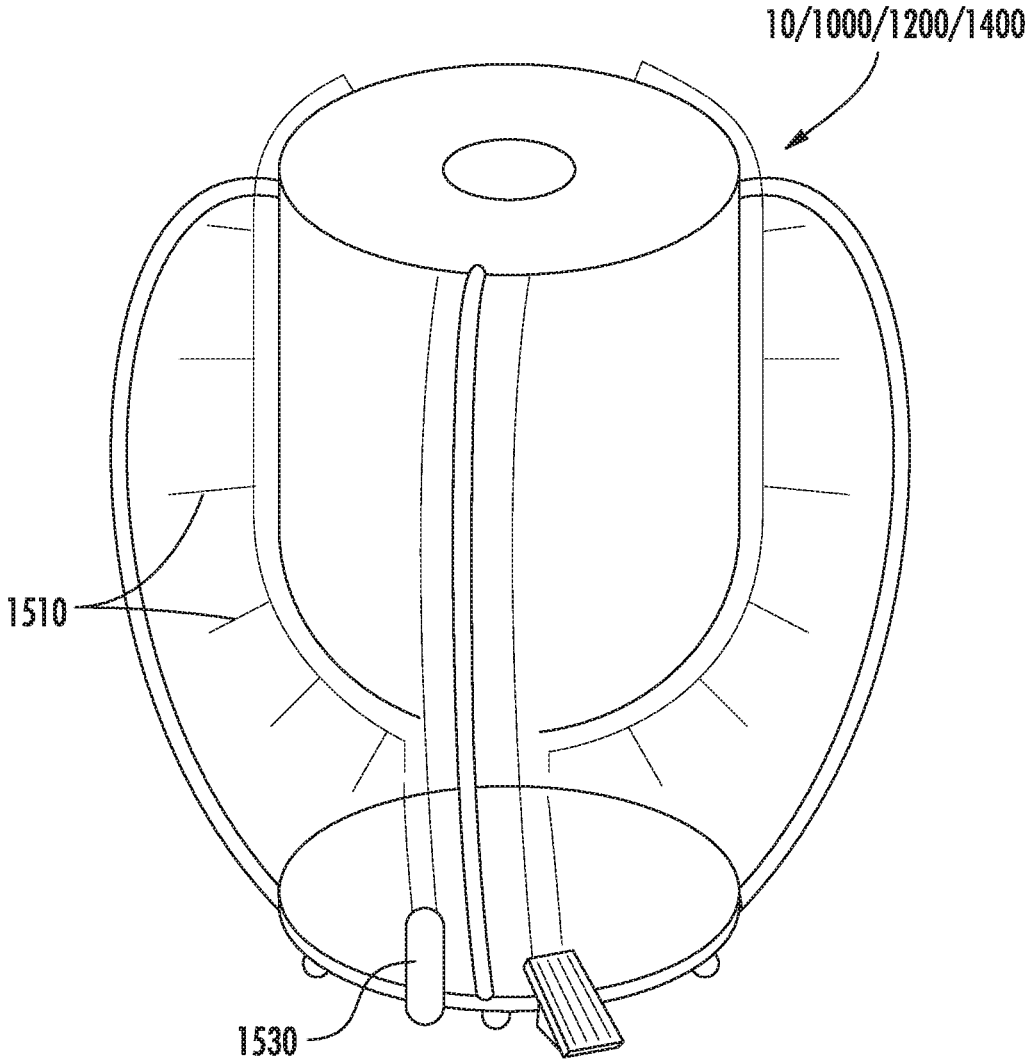
Figure 32A:
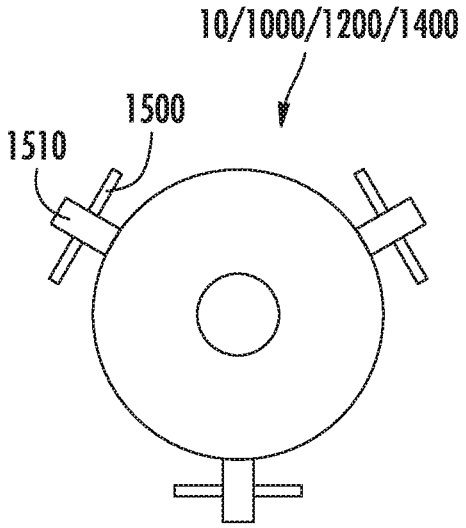
Figure 32B:
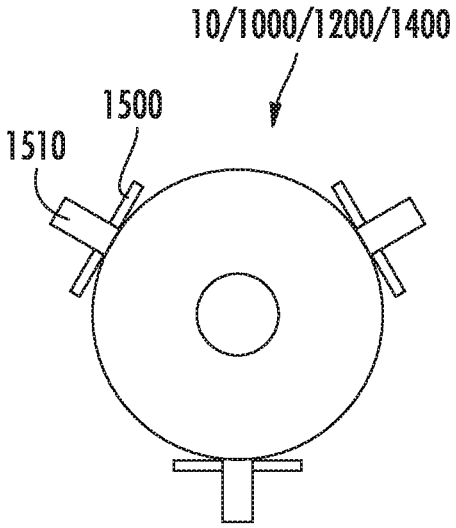
Figure 33:
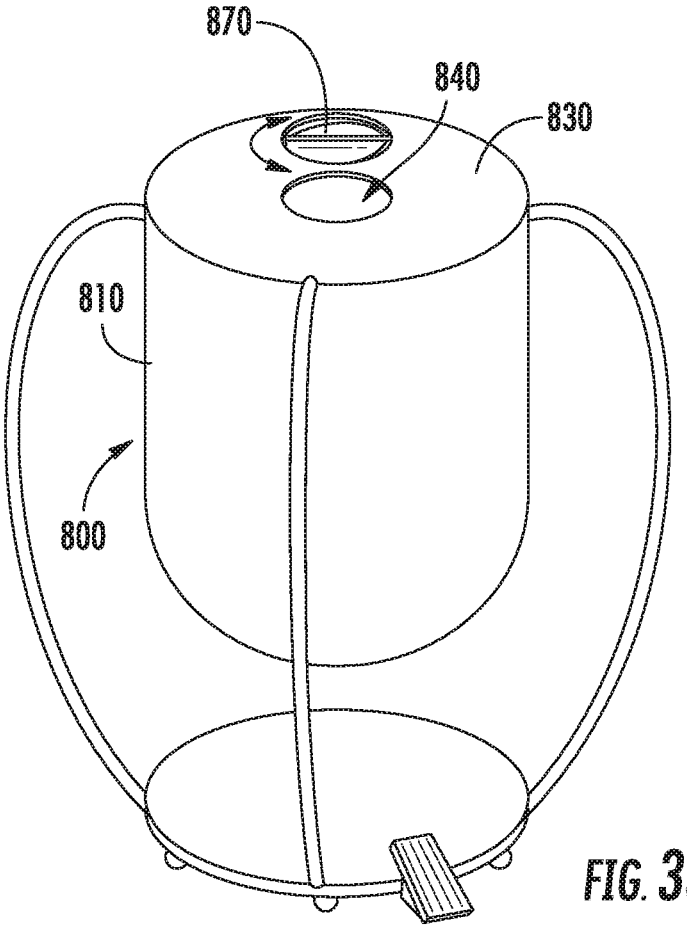

FIG. 10 illustrates a side perspective view of a variable pitch and/or tone idiophone, according to one or more examples of embodiments;

FIG. 11 illustrates a side perspective view of a variable pitch and/or tone idiophone, according to one or more examples of embodiments;

FIG. 12 illustrates a set of vessels that may be utilized in connection with the variable pitch and/or tone idiophone of FIG. 11, according to one or more examples of embodiments;

FIG. 13 illustrates a side perspective view of a variable pitch and/or tone idiophone, according to one or more examples of embodiments;

FIG. 14 illustrates a side perspective view of a vessel component of the variable pitch and/or tone idiophone of FIG. 13, according to one or more examples of embodiments;

FIG. 15 illustrates a side perspective view of a variable pitch and/or tone idiophone, according to one or more examples of embodiments;

FIG. 16 illustrates a side perspective view of a variable pitch and/or tone idiophone, according to one or more examples of embodiments;

FIG. 17 illustrates a side perspective view of a variable pitch and/or tone idiophone, according to one or more examples of embodiments;

FIG. 18 illustrates a side perspective view of a variable pitch and/or tone idiophone, according to one or more examples of embodiments;

FIG. 19 illustrates a side perspective view of a variable pitch and/or tone idiophone, according to various examples of embodiments;

FIG. 20 illustrates a side view of a variable pitch and/or tone idiophone, according to various examples of embodiments;

FIG. 21 illustrates a side perspective view of a variable pitch and/or tone idiophone, according to one or more examples of embodiments;

FIG. 22 illustrates a side perspective view of a variable pitch and/or tone idiophone, according to one or more examples of embodiments;

FIG. 23 illustrates a side perspective view of a variable pitch and/or tone idiophone, according to one or more examples of embodiments;

FIG. 24 illustrates a side perspective view of a variable pitch and/or idiophone, according to various examples of embodiments;

FIG. 25 illustrates a side perspective view of a tuning apparatus of an idiophone, according to various examples of embodiments;

FIG. 26 illustrates a side perspective view of a variable pitch and/or tone idiophone, according to various examples of embodiments;

FIG. 27 illustrates a side perspective view of an electromagnet apparatus included in a variable pitch and/or tone idiophone utilizing electromagnetic displacement, according to various examples of embodiments;

FIGS. 28A-28C illustrate side perspective views of a vessel of a variable pitch and/or tone idiophone utilizing electromagnetic displacement, according to various examples of embodiments;

FIGS. 29A-29C illustrate side perspective views of a vessel of a variable pitch and/or tone idiophone utilizing electromagnetic displacement in various states of activation, according to various examples of embodiments;

FIG. 30 illustrates a side perspective exploded view of an electromagnetic apparatus for a variable pitch and/or tone idiophone utilizing electromagnetic displacement, according to various examples of embodiments;

FIG. 31 illustrates a side perspective view of a variable pitch and/or tone idiophone, including damper sleeves and damper connectors, according to various examples of embodiments;

FIGS. 32A-32B illustrate top views of the variable pitch and/or tone idiophone illustrated in FIG. 31 with dampers in an open and closed state, respectively, in various examples of embodiments;

FIG. 33 illustrates a perspective view of a variable pitch and/or tone idiophone including a butterfly valve, according to various examples of embodiments;

It should be understood that the drawings are not necessarily to scale. In certain instances, details that are not necessary to the understanding of the invention or render other details difficult to perceive may have been omitted. It should be understood, of course, that the invention is not necessarily limited to the particular embodiments illustrated herein.

DETAILED DESCRIPTION

Referring to the Figures, a variable pitch and/or tone idiophone, and method for playing same, is provided.

Figure 1:
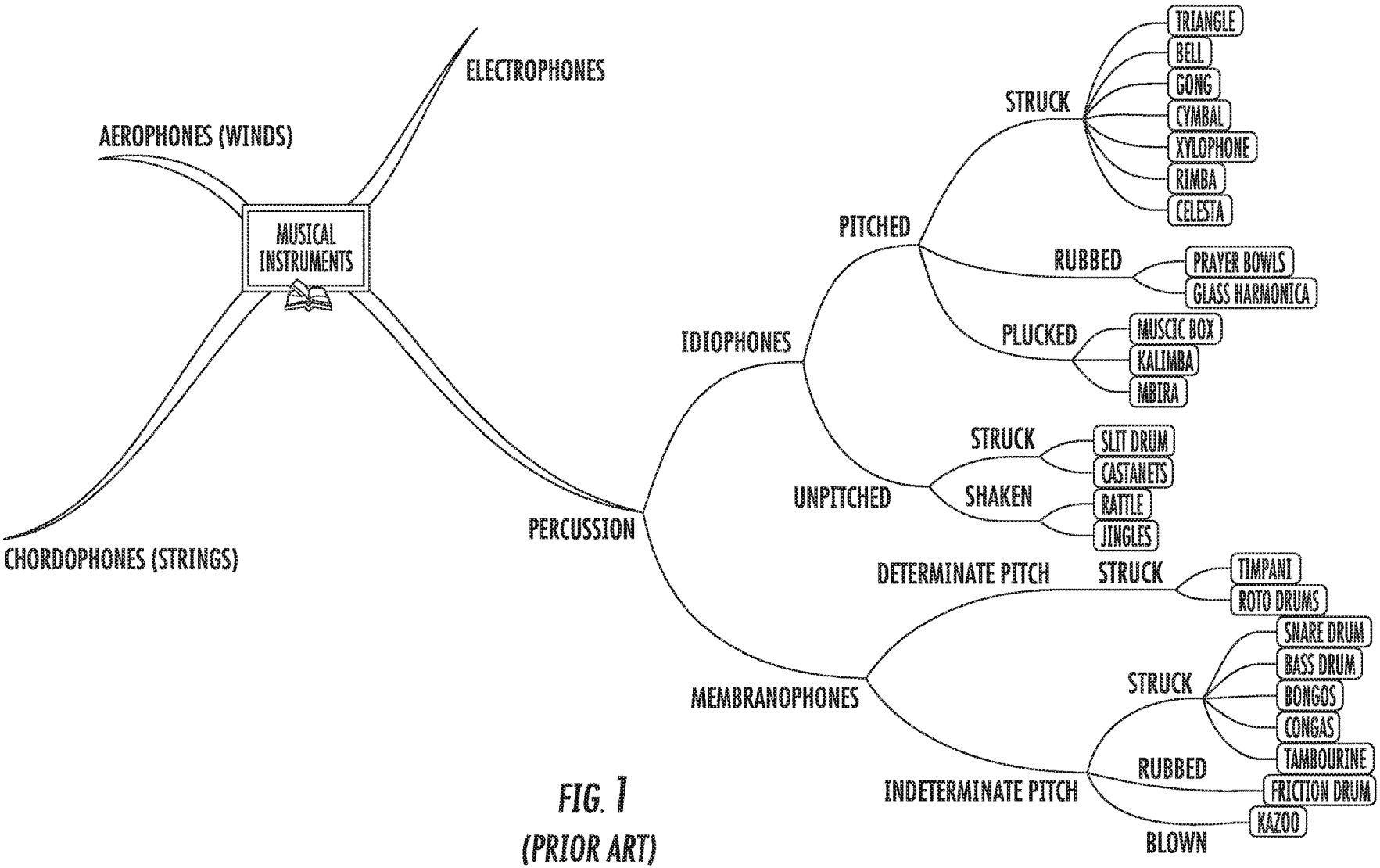
FIG. 1 (PRIOR ART)
FIG. 1 illustrates a partial known classification or taxonomy of musical instruments.
Figure 2:
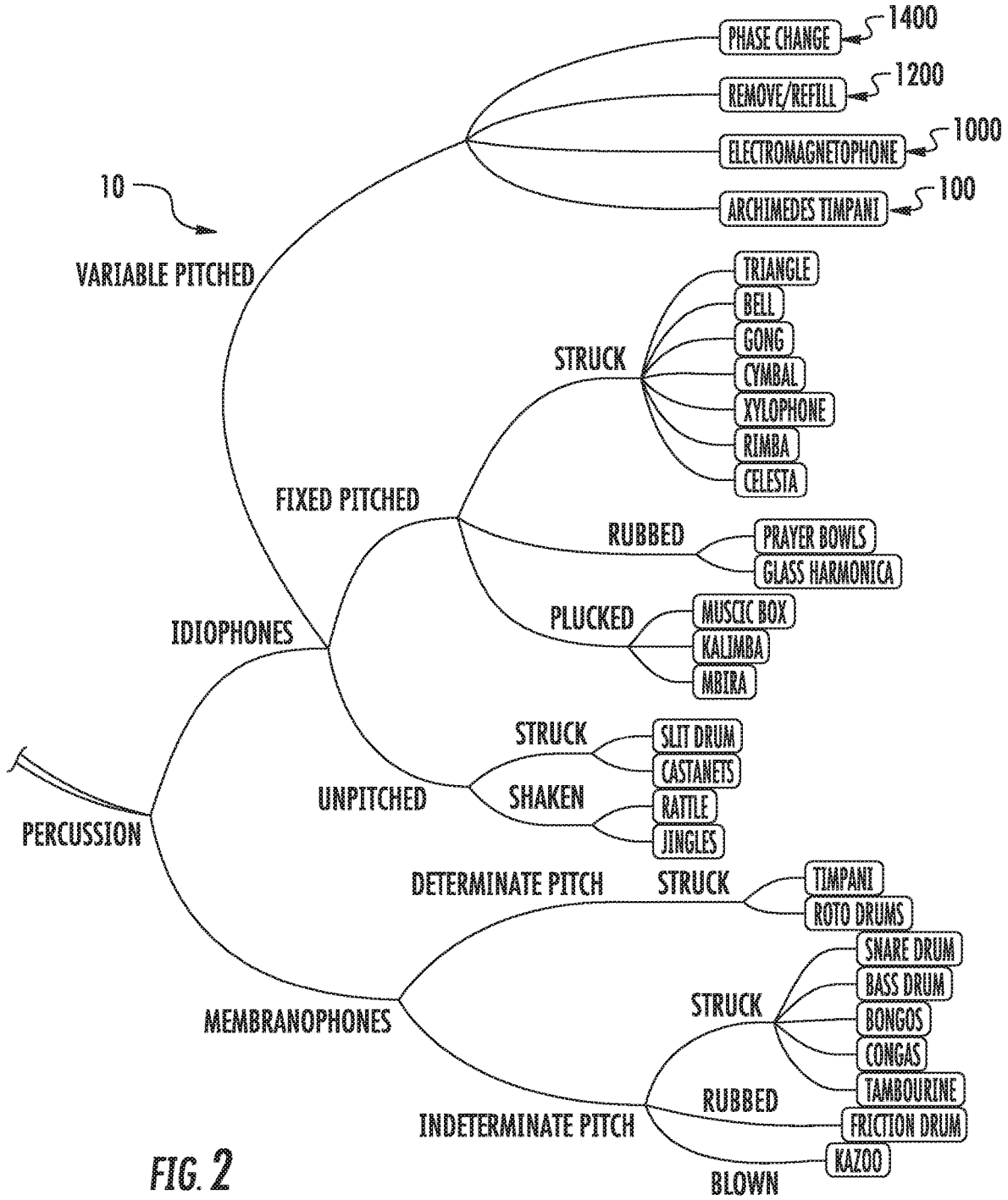
FIG. 2 illustrates a new classification or taxonomy of percussion-related instruments, including variable pitch and/ or tone idiophones of the present disclosure according to various examples of embodiments.

Referring to FIG. 2, disclosed herein is a new category of idiophone, generally referred to herein as a variable pitch and/or tone idiophone 10. While variable pitch and/or tone idiophone 10 may take a variety of forms or species, as illustrated in FIG. 2 such forms include and are sometimes referred to herein as an "Archimedes timpani" 100, an "electromagnetophone" idiophone 1000, a "remove/refill" idiophone 1200, and a "phase change" idiophone 1400.

Referring to FIG. 3, the various forms of variable pitch and/or tone idiophones 10, including Archimedes timpani idiophone 100, electromagnetophone 1000, remove/refill idiophone 1200, and phase change idiophone 1400, each have their own variations or embodiments. For example, various embodiments of electromagnetophone 1000 include a controlled dip electromagnetophone and an inverted buoy electromagnetophone.

Various embodiments of phase change variable tone and/or pitch idiophone 1400 allow for change or variation of pitch and/or tone using phase changes such as sublimation and deposition, vaporization and condensation, and/or freezing and melting. Various embodiments of remove/refill variable pitch and/or tone idiophone 1200 utilize a variety of apparatus and/or methods including, without limitation, pumping, syphoning, suctioning, draining, and/or blow out, to remove and refill fluid in a vessel.

Various embodiments of an Archimedes timpani idiophone include a stacked or nested idiophone (as further illustrated in FIGS. 10-12), a mushroom anchor idiophone (as further illustrated in FIGS. 13-14, a controlled dip idiophone (as further illustrated in FIG. 15, a nesting high hat idiophone (as further illustrated in FIG. 16), a buoy idiophone (as further illustrated in FIGS. 17-19), etc., a glass xylophone idiophone (as further illustrated in FIG. 20), and a playable surface idiophone (as further illustrated in FIGS. 21-23).

Similar to how known timpani can and have been used to replace many large membranophone instruments by being tunable, variable pitch and/or tone idiophones 10 including Archimedes timpani 100 may replace or supplement many known idiophones by being able and readily configured to readily change pitch and/or tone (e.g., from a single strike, rub, scrape, or pluck).

Archimedes timpani 100 is based on the known Archimedes principle, which is based on the fact that, for practical purposes, liquid is incompressible. The Archimedes principle states that an object will therefore displace an amount of liquid equal to its own volume. In various embodiments, idiophones 10 including Archimedes timpani 100 utilizes displacement (e.g., adjustable displacement of a fluid in a vessel) to produce a variable or adjustable pitch and/or tone.

Referring now to FIGS. 4-7, various embodiments of Archimedes timpani 100 include similar basic components. In various embodiments, idiophone 100 includes a first vessel (or resonant vessel) 110 and a second member or vessel (or resonant vessel) 130.

In various embodiments, first vessel 110 includes a peripheral sidewall 112 and a bottom floor or section 114. In various embodiments, bottom floor or section 114 is coupled to or formed integral with peripheral sidewall 112 so as to form a liquid receiving receptacle 116 open at an upper end 118 of peripheral sidewall 112. In various embodiments, upper end 118 of peripheral sidewall 112 terminates in a rim (e.g., annular rim) 120.

In various embodiments, second vessel 130 is configured similarly to first vessel 110, albeit at a smaller scale at least in width, diameter and/or circumference, so as to be nestable or provided in a nested relation (e.g., a spaced-apart nested relation) with first vessel 110. In various embodiments, second vessel 130 includes a peripheral sidewall 132 and a bottom floor or section 134. In various embodiments, bottom section 134 is coupled to or formed integral with peripheral sidewall 132 so as to form a liquid receiving receptacle 136 open at an upper end 138 of peripheral sidewall 132. In various embodiments, upper end 138 of peripheral sidewall 132 terminates in a rim (e.g., annular rim) 140. However, it should be appreciated that the second vessel or member need not be similarly configured to first vessel 110. For example, the second vessel or member may be a closed vessel (e.g., similar to a buoy) and or solid in nature such that it is not configured to retain a liquid.

In various embodiments, first vessel 110 and/or second member or vessel 130 are configured to make a pitch and/or tone (and/or range of pitches and/or tones) when vibrated (e.g., by striking, rubbing, scraping, plucking, and/or shaking). First vessel 110 may be configured to product a different pitch and/or tone (or range of pitches and/or tones) than second vessel or member 130 when each are similarly contacted, resonated, or vibrated. In various embodiments, second vessel or member 130 is sized to fit into liquid receiving receptacle 116 of first vessel 110. In various embodiments, first vessel 110 also retains at least one liquid 122 within receptacle 116.

In various embodiments, idiophone 100 includes a third member or vessel (or resonant vessel) 150. In various embodiments, third vessel 150 is a closed vessel (e.g., similar to a buoy) and or solid in nature such that it is not configured to retain a liquid. In various examples of embodiments, third vessel 150 is smaller in dimension than second vessel 130 at least in width, diameter and/or circumference, so as to be nestable or provided in a nested relation (e.g., a spaced-apart nested relation) with second vessel 130. In various embodiments, second vessel 150 includes a peripheral sidewall 152 and a bottom floor or section 154. However, it should be appreciated that the third vessel or member need not be similarly configured to second vessel 110.

In various other embodiments, bottom section 154 is coupled to or formed integral with peripheral sidewall 152 to form a liquid receiving receptacle 156 open at an upper end 158 of peripheral sidewall 152. In various embodiments, upper end 158 of peripheral sidewall 152 terminates in a rim (e.g., annular rim) 160.

In operation, and referring more specifically to FIGS. 5-7, first vessel 110 and/or second vessel or member 130 are moved relative to each other, such that second vessel or member 130 is moved into or within liquid receiving receptacle 116 defined by first vessel 110 and into liquid 122 retained or held within liquid receiving receptacle 116. As second vessel or member 130 is moved into or within liquid receiving receptacle 116 of first vessel 110, and, more particularly, liquid 122 retained by or within first vessel 110, liquid 122 (or the level of liquid 122) in first vessel 110 is displaced further up sidewall 112 of first vessel 110, and helps raise the relative pitch or tone of first vessel 110 when and/or while it is vibrated or played.

In various embodiments, when third vessel 150 is also utilized, second vessel 130 is moved relative to first vessel 110 and third vessel 150. When idiophone 100 includes and/or utilizes third vessel 150, second vessel 130 retains a liquid 142 in liquid receiving receptacle 136. In various embodiments, second vessel 130 is moved, and/or third vessel 150 is moved, such that third vessel 150 is provided into and/or within liquid receiving receptacle 136 of second vessel 130. In various embodiments, third vessel 150 is moved into and/or within liquid 142 retained or provided in second vessel 130. In various embodiments, when idiophone or instrument 100 includes first vessel 110, second vessel 130, and third vessel 150, with first vessel 110 and second vessel 130 each having, holding or retaining a respective liquid or liquids therein, moving second vessel 130 away from first vessel 110, and toward third vessel 150, third vessel or member 150 displaces fluid 142, and/or increases and/or raises a level of liquid relative to sidewall 132 of second vessel 130 corresponding to the amount of displaced liquid caused by third vessel 150, and replaces fluid 122, and/or decreases or lowers a level of liquid 122 in first vessel 110 as second vessel 130 is moved out of liquid 122 in first vessel 110. As a result, the relative tone and/or pitch that is being and/or may be produced by second vessel 130 is raised, and the tone and/or pitch that is being and/or may be produced by first vessel 110 and third vessel 150 is lowered.

In operation, in various embodiments, moving second vessel 130 toward or closer to first vessel 110 and away or farther from third vessel 150 replaces fluid 142 to reduce the liquid level inside second vessel 130 as it moves toward first vessel 110, and displaces liquid 122 to increase the liquid level inside first vessel 110. As a result, in various embodiments, the relative pitch and/or tone of second vessel 130 is lowered while relative pitches and/or tones of first and third vessels 110/150 are raised.

In other words, the pitch and/or tone of a resonant vessel may be changed by displacing the fluid or liquid inside that vessel. In addition, in various embodiments, if an additional resonant vessel is used to displace the fluid or liquid inside the first resonant vessel, the displaced fluid rises around the additional resonant vessel and also varies the pitch and/or tone of the additional resonant vessel.

Referring now to FIG. 8, in various embodiments, third vessel or member 150 defines an aperture 164 within bottom floor or section 154 of vessel 150. In various embodiments, bottom floor 154 defines aperture 164. In various embodiments, a fourth vessel 170 having a bottom base 174 may be provided within liquid receiving receptacle 156 of third vessel 150. In various embodiments, fourth vessel 170 may extend into or through aperture 164. In various embodiments, fourth vessel 170 may be provided in liquid receiving receptacle 156 of third vessel 150 and into aperture 164, such that bottom base 174 of fourth vessel 170 is substantially aligned with aperture 164 of third vessel 150. In various embodiments, fluctuations or changes in liquid level in second vessel 130 and/or first vessel 110 also varies the pitch and/or tone of vibrating fourth vessel 170.

The vessels may each take a variety of shapes, sizes, and make-ups, for example, as desired to affect resonance and/or playability. For example, as illustrated in FIG. 9, one or more of the vessels may be in the shape of and/or have properties of or similar to a mason jar 180. As also illustrated in FIG. 8, one or more of the vessels may be in the shape of and/or have properties of or similar to a snifter glass 185. In various embodiments, one or more of the vessels may be in the shape of and/or have properties of or similar to a slider stem 190. Mason jar 180, slider stem 190, and snifter 185 each have different shapes, properties and/or characteristics, and these properties and/or characteristics may affect each vessel's resonance, pitch and/or tone, and how the vessel is vibrated or played (e.g., whether it is struck, scraped, or rubbed). For example, mason jar 180 is typically not configured to audibly vibrate from rubbing because the tops or top edges are too rigid. In contrast, snifter 185 or other stemmed glassware may typically be rubbed to create an audible pitch and/or tone because the material around and/or forming the rim is flexible enough to audibly vibrate in response to rubbing.

However, mason jar-like vessel design 180, with its more rigid and/or thicker neck, tends to be relatively optimal for suspending the vessel from its neck (e.g., with a cable). In contrast, snifter-like vessel 185 suspended in a cable system may be complicated to engineer and relatively more susceptible to damage from playing and pressures from the cable system or activation thereof. In various embodiments, however, slider stem-like design 190 (which may be similar to a slider and a water pipe) has a rigid central rim for support but a rim or top area sufficiently flexible to be audibly vibrated with rubbing, while allowing other vessels and/or objects to be inserted and/or manipulated therein. In various embodiments, the vessels may be constructed of any number of materials or combinations of materials including glass, ceramic, stone, and various metals. In various embodiments, the vessels are watertight or at least substantially watertight, apart from any top opening on each.

In various embodiments, one or more vessels of the idiophones of the present disclosure may include textures or notches on the outside of the vessels and/or on a support structure therefor to allow the vessel to produce different pitches or tones or sounds by rubbing a stick or tines along the notches or textures.

Further, vessel size can also affect tone or pitch. In general, the larger the vessel, the lower the pitch, and the smaller the vessel, the higher the pitch. In various embodiments, sets of multiple resonant vessels of various sizes are utilized to provide different pitches.

Referring now to FIGS. 10-12, a nested or stacked instrument or idiophone 200 is illustrated, according to various examples of embodiments. In various embodiments, stacked idiophone 200 includes a first resonant vessel 210, and a second resonant vessel 230, provided in a stacked, nested, spaced-apart arrangement. In various embodiments, nested or stacked instrument or idiophone 200 also includes a third resonant vessel 250 provided in a nested arrangement with the second resonant vessel 230. In various embodiments, vessels 210/230/250 are similar to vessels 110/130/150 described above. In various embodiments, each vessel 210/230 is suspended by its neck or rim, or otherwise suspended to allow vessels 210/230 to resonate as desired (e.g., freely, without undesirable vibration, etc.). In various embodiments, first vessel 210 is partially filled with a liquid 212. In various embodiments, first vessel is relatively stationary, while second vessel 230 is moveable relative to first vessel 210 (e.g., up and down, using a cable and/or mechanism activated by a pedal similar to a timpani pedal system used to move a timpani hoop up and down).

In various embodiments, third resonant vessel 250 is also suspended by its neck or rim, or otherwise suspended to allow it to resonate as desired (e.g., freely, without undesirable vibration, etc.). In various embodiments, second vessel 230 is partially filled with a liquid 232. In various embodiments, third vessel 250 is stationary relative to first vessel 210 while second vessel 230 is movable relative to first vessel 210 and third vessel 250. It should be appreciated, however, that the first vessel and/or the third vessel may also be moveable relative to the second vessel.

In operation, in various embodiments, a musician or a performer may play the stacked idiophone 200 by striking, scraping, bowing, and/or rubbing one or more of the vessels to cause one or more of the vessels to vibrate and/or resonate, and moving second vessel 230 relative to first vessel 210 and/or third vessel 250. In various embodiments, as second vessel 230 is moved (e.g., up and down and/or back and forth) relative to adjoining first and/or third vessels 210/250, liquid 232 is displaced and/or replaced in second vessel 230 and/or liquid 212 is displaced and/or replaced in first vessel 210 thereby changing the liquid level relative to the sidewalls of those vessels and the corresponding pitches and/or tones those vessels produce while vibrating or resonating.

Referring now to FIGS. 13 and 14, a "mushroom anchor" instrument or idiophone 300 is illustrated. In various embodiments, idiophone 300 includes first and second mushroom anchor-shaped vessels 310 and 330. In various embodiments, idiophone 300 also includes a third mushroom anchor-shaped vessel 350.

In various embodiments, second vessel 330 includes a shaped portion 332 helping define a liquid receiving reservoir 334 for retaining or holding a liquid, and a stem or bell clapper 336 having a head 338, wherein head 338 and stem 336 define a hollow shaft or channel 340. In various embodiments, head 338 includes a distributed crown 342.

In various embodiments, vessels 310 and 350 are similar in design to vessel 330. Vessels 310 and 350 each includes a respective shaped portion 312/352, each helping define a respective liquid receiving reservoir 314/354 for retaining or holding a liquid, and a respective stem or bell clapper 316/356, defining a respective head 318/358, wherein head 318/358 and stem 316/356 each defines a respective hollow shaft or channel 320/360. In various embodiments, head 318/358 includes a respective distributed crown 322/362. The main difference between vessels 310, 330, and 350 is that various components of the vessels including the liquid reservoir, stem or bell clapper, hollow shaft, etc. are sized and shaped to allow the vessels to be provided in a spaced nested or nestable arrangement.

In various embodiments, vessels 310 and 330 (and any vessel 350) are provided along and around a central shaft 370 running through channels 320/340 defined by stems 316/336 and heads 318/338. In various embodiments, central shaft 370 also runs through channel 360. In various embodiments, vessels 310/330 (and, in various embodiments, vessel 350) are each retained relative to central shaft 370 and each other (e.g., using one or more hanging cables 380 or cable assemblies coupled to their respective crowns). In various embodiments, cables 380 help retain first vessel 310 relative to shaft 370 and any third vessel, while allowing second vessel 330 to move or be moved along shaft 370 relative to the one or more other vessels to displace the liquid retained in first vessel 310 and/or second vessel 330 and change the vibrating or resonating tone and/or pitch of one or more vessels 310/330/350 and/or the instrument 300.

Referring now to FIG. 15, a "controlled dip" idiophone or instrument 400 is illustrated. In various embodiments, instrument 400 includes a first vessel 410, including a peripheral sidewall 412 and a bottom floor or section 414. In various embodiments, bottom floor or section 414 is coupled to or formed integral with sidewall 412 so as to form a liquid receiving receptacle 416 open at an upper end 418 of peripheral sidewall 412. In various embodiments, a liquid is also provided in liquid receiving receptacle 416.

In various embodiments, at least one second vessel 430 is suspended or otherwise provided in liquid receiving receptacle 416. In various embodiments, each second vessel 430 is tubular with opposing ends, at least one of which opposing ends is closed. However, the second vessel may be open at one or both opposing ends. In various examples of embodiments, multiple second vessels 430 are each shaped differently. For example, as shown in FIG. 15, second vessels 430 may have different or staggered lengths. In other examples of embodiments, the second vessels may have different widths, volumes, etc. In various examples of embodiments, the second vessels are sized and arranged in a seven and five arrangement (i.e., seven sharps and five flats arrangement).

In operation, in various embodiments, a foot pedal 440 is utilized to activate a mechanism useable to move first vessel 410 (e.g., by adjusting a support or framework on which the first vessel is provided) and/or second vessel(s) 430 (e.g., using one or more cables coupled to tubular vessels 430) relative to each other to displace or replace liquid relative to the sidewalls of first vessel 410 and/or second vessels 430. In various embodiments, one or more second vessels 430 are moved (either together, in various groups, or individually) relative to the liquid in liquid receiving receptacle to change and/or vary a pitch and/or tone produced by the second vessel(s) when struck, rubbed or otherwise vibrated. In operation in other various embodiments, the first vessel and the liquid therein is moved relative to the tubular vessel(s) to change and/or vary a pitch and/or tone produced by the second vessel(s) when struck, rubbed or otherwise vibrated. The pitch and/or tone of first vessel when struck, rubbed or otherwise vibrated may also be changed and/or varied as the first vessel and/or the second vessel(s) are moved relative to each other. In various embodiments, each second vessel 430 is used as a sounding or vibrating surface and changes tone and/or pitch as it is moved within the liquid retained in first vessel 410.

Referring now to FIG. 16, a "hi hat" idiophone or instrument 500 is illustrated. In various embodiments, instrument 500 includes a first vessel or member 510, including a peripheral sidewall 512 and a bottom floor or section 514. In various embodiments, bottom floor or section 514 is coupled to or formed integral with sidewall 512 so as to form a liquid receiving receptacle 516 open at an upper end 518 of peripheral sidewall 512. In various embodiments, a liquid 522 is also provided in liquid receiving receptacle 516.

In various embodiments, a second member or vessel 530 is suspended or provided in liquid receiving receptacle 416. In various examples of embodiments, second member or vessel 530 is slidably or moveably retained in a hi hat clutch 535 on a hi hat stand 537 such that the second member or vessel may be moved in and out or within liquid 522 in first vessel 510.

In operation, in various embodiments, a foot pedal 540 is utilized to move second member 530 relative to first vessel 510 (e.g., similar to how a top hi hat cymbal is moved relative to a bottom hi hat cymbal) to displace or replace liquid 522 relative to the sidewalls of first vessel 510 and/or second vessel 530 and change and/or vary a pitch and/or tone produced by the first vessel 510 and/or second vessel 530 when or while either or both vessels are struck, rubbed or otherwise vibrated.

Referring now to FIGS. 17-19, various examples of a "buoy" instrument or idiophone 600 are illustrated. In various embodiments, instrument 600 includes a first vessel 610, including a peripheral sidewall 612 and a bottom floor or section 614. In various embodiments, bottom floor or section 614 is coupled to or formed integral with sidewall 612 so as to form a liquid receiving receptacle 616 open at an upper end 618 of peripheral sidewall 612. In various embodiments, a second vessel 630 is provided in liquid receiving receptacle 616. In various embodiments, second vessel 630 is a buoy. In various embodiments, a liquid 622 is also provided in liquid receiving receptacle 616.

In various embodiments, a foot pedal 640 may be utilized to activate a mechanism useable to move second vessel 630 (e.g., using a cable coupled to second vessel 630) relative to (e.g., up and down within) first vessel 610 to displace or replace liquid 622 retained therein. As shown in the figures, first vessel 610 and/or second vessel 630 may each take a variety of shapes. As illustrated, first vessel 610 may be held and/or suspended (e.g., within a frame or framework 650, as illustrated in FIGS. 17 and 18), and/or be provided on a pedestal 660 as illustrated in FIG. 19 (e.g., to help limit sound interferences and/or optimize sound predictability).

In various embodiments, second vessel 630 is also used as a sounding or vibrating surface and, like first vessel 610 in which it is provided, also changes tone and/or pitch as it is moved within liquid 622 retained in first vessel 610. It should be appreciated, however, that the second vessel may also be an unpitched idiophone, such as a water drum or membranophone. In various embodiments, the second vessel utilized in connection with idiophones of the present disclosure may be replaceable or exchangeable with other vessels, buoys or buoy inserts having a variety of sonic properties.

Referring more specifically to FIG. 19, in various embodiments, idiophone 600 also includes a member 670 (e.g., as shown, a member in the shape of a hurricane glass) provided between first vessel 610 and second vessel 630.

Referring now to FIG. 20, a glass xylophone or bottle xylophone 700, according to various embodiments, is illustrated. In various embodiments, instrument 700 includes multiple first vessels 710, including a peripheral sidewall 712 and a bottom floor or section 714. In various embodiments, bottom floor or section 714 is coupled to or formed integral with sidewall 712 so as to form a liquid receiving receptacle 716. In various embodiments, a second vessel 730 is provided in liquid receiving receptacle 716 of each first vessel 710. In various embodiments, a liquid 722 is also provided in liquid receiving receptacle 716 of each first vessel 710.

The first vessels and/or the second vessels may each take a variety of shapes. As illustrated, first vessels 710 may be held and/or suspended (e.g., within a frame or framework 750. In various examples of embodiments, first vessels 730 are sized and arranged in a seven and five arrangement (i.e., seven sharps and five flats arrangement).

In operation in various embodiments, one or more foot pedals are utilized to activate one or more mechanisms useable to move one or more second vessels 730 (e.g., using one or more wires or cables (e.g., snaked through the frame or framework 750 or attached to the outside of it) coupled to each second vessel 730) relative to (e.g., up and down within) the first vessel 710 to displace or replace liquid 722 retained therein. In various embodiments, one or more second vessels 730 are moved (either together, in various groups, or individually) relative to and within liquid 722 in each corresponding liquid receiving receptacle 716 to change and/or vary a pitch and/or tone produced by first vessel(s) 710 when struck, rubbed or otherwise vibrated. In various embodiments, each first vessel 710 is used as a sounding or vibrating surface and changes tone and/or pitch as each second vessel therein is moved within liquid 722 retained in each first vessel 710.

Referring now to FIGS. 21-23, a playable surface instrument or idiophone 800 is illustrated. In various embodiments, idiophone 800 includes a first vessel 810 including a peripheral sidewall 812 coupled to or integrally formed with a bottom section 814 so as to form a liquid receiving receptacle 816, having an upper end 818 terminating in a rim 820. In various embodiments, first vessel 810 and/or liquid receiving receptacle 816 are at least partially enclosed around rim 820 by a playable surface 830. In various embodiments, an aperture or opening 840 is defined in or by playable surface 830 to allow liquid and one or more second vessels and/or displacement devices 860 (e.g., a buoy) to be provided into and moved within liquid receiving receptacle 816 of first vessel 810. In various embodiments, playable surface 830 is contacted or vibrated to create sound. First vessel 810 may also be vibrated or played on its sidewall. In addition, displacement device 860 may also be vibrated or otherwise played. Additionally, as illustrated in FIGS. 21-22, first vessel 810 may be suspended or otherwise provided in a frame or framework 870 to help it to resonate more freely than it may otherwise if not suspended.

Referring now to FIGS. 24-25, a tunable idiophone 900 (e.g., a tunable Archimedes timpani) according to various examples of embodiments is illustrated. In various embodiments, idiophone 900 includes a first vessel 910 including a sidewall 912, and a bottom section 914 coupled to or formed integrally with sidewall 912 to form a liquid receiving receptacle 916 open at an upper end 918 of sidewall 912. In various embodiments, a liquid 922 is provided in liquid receiving receptacle 916. In various embodiments, siphons and pumps controlled for example with foot pedals move liquid 922 in and out of first vessel 910. The liquid level in first vessel may also be altered by diversion of flowing water into and out of the first vessel.

In various embodiments, idiophone 900 includes a tuning gauge 950. Referring more specifically to FIG. 25, in various embodiments, tuning gauge 950 includes a tube 960 open at its opposing ends. In various embodiments, one opposing end 965 of tube 960 is provided into first fluid 922 (e.g., water) at least temporarily received by first vessel 910 such that first fluid 922 enters tube 960. In various embodiments, a layer of a second fluid 970 (e.g., oil) that is less dense than first fluid 922 (e.g., water) is provided on top of first fluid in tube 960. Density sorting prevents second fluid 970 from mixing with first fluid 922, and, in various embodiments, second fluid 970 floats on top of first fluid 922. In various embodiments, tuning gauge 950 may include one or more lines or other indicators 980 thereon (e.g., like those on a graduated cylinder or thermometer) or another mechanism (e.g., like that on a standard timpani) to help a performer or user tune idiophone 900 (e.g., by using a foot pedal to match a second fluid level with indicator 980).

Referring now to FIGS. 26-30, various embodiments of an "electromagnetophone" or idiophone utilizing electromagnetic displacement 1000 and components thereof are illustrated. In various embodiments, idiophone 1000, which utilizes electromagnetic displacement to provide variable pitch and/or tone, includes a first vessel 1010 including a sidewall or peripheral sidewall 1012 and a bottom section 1014. In various embodiments, sidewall 1012 and bottom section 1014 form a fluid receiving receptacle 1016. While the figures show first vessel 1010 open at an upper end of sidewall 1012, the upper end may be closed. In various embodiments, fluid receiving receptacle 1016 retains or holds a magnetic ferrofluid 1022 and an electromagnet apparatus 1050 provided into magnetic ferrofluid 1022. In various embodiments, electromagnet apparatus 1050 is electrically coupled to an electrical power source or supply and ground and/or grounded outlet.

In various embodiments, and referring more specifically to FIGS. 27 and 30, electromagnetic apparatus 1050 includes an electromagnet 1060, which may be sheathed in a nonconductive layer 1070 to help protect a user or performer from electrocution and related or other harm, while allowing electromagnetic forces to pass through to attract and repel magnetic ferrofluid 1022 and/or other objects such as resin-embedded objects. In various embodiments, electromagnetic apparatus is coupled to power through a ground fault circuit interrupter.

In various embodiments, vessel 1010 is nonconductive. In various embodiments, the vessel may also be coupled and/or suspended within or by to a frame, which may be grounded. In various embodiments, electromagnet 1050 is actuated (e.g., magnetized and/or demagnetized, e.g., using electricity) and/or controlled using a foot pedal (e.g., a wah wah pedal) 1080.

Referring more specifically to FIGS. 28A-28C and 29A-29C, in operation, electromagnet apparatus 1050 may be actuated into an attraction or magnetic state (e.g., by the foot pedal). In an attraction or magnetic state, as illustrated in FIGS. 28A and 29A, electromagnet apparatus 1050 attracts magnetic ferrofluid 1022 or resin-embedded objects retained in vessel 1010, causing the amount or level of ferrofluid 1022 or resin-embedded objects in contact with electromagnet apparatus 1050 to increase while causing the amount or level of ferrofluid 1022 and/or resin-embedded objects in contact with sidewall 1012 of vessel 1010 to decrease. In such a magnetic state, the pitch and/or tone of sounding vessel 1010 or idiophone 1000 is relatively lower when resonated and/or vibrated (e.g., rubbed, struck, scraped, or otherwise played) than when electromagnet apparatus 1050 is in a magnetically neutral state as illustrated in FIGS. 28B and 29B, and/or in a magnetically repulsive state as illustrated in FIGS. 28C and 29C.

In various embodiments, electromagnet apparatus 1050 may be placed in the magnetically neutral state or otherwise inactivated (see FIGS. 28B and 29B) to help allow or induce magnetic ferrofluid 1022 and/or resin-embedded objects in vessel 1010 to return to a more neutral or level surface state.

In various embodiments, electromagnet apparatus 1050 may be activated into a repulsion state (see FIGS. 28C and 29C) to repel magnetic ferrofluid 1022 and/or resin-embedded objects from electromagnet apparatus 1050 and reduce the amount of ferrofluid 1030 and/or number of resin-embedded objects in contact with electromagnet apparatus 1050. In various embodiments, the repulsion state of electromagnet apparatus 1050 helps also cause magnetic ferrofluid 1022 and/or resin-embedded objects to be displaced and contact relatively more of sidewall 1012 of sounding vessel 1010. In various embodiments, such repulsion state also changes the relative pitch and/or tone of idiophone 1000 or vessel 1010 compared to a neutral or attraction state. In various embodiments, the repulsion state results in or gives vessel 1010 or idiophone 1000 a higher pitch or tone when vibrated, relative to a neutral or attraction state.

Variable pitch and/or variable tone idiophone 100/1000/1200/1400 may include other features, apparatus, or attachments. For example, and referring now to FIGS. 31 and 32A-32B, in various embodiments, idiophone 100/1000/1200/1400 includes one or more damper sleeves 1500 provided on one or more damper connectors 1510. In various embodiments, damper sleeves 1500 may be a felt-like or felt material provided between damper connectors 1510 and/or suspension brackets 1520 that may be pressed or squeezed against a vessel (e.g., using a pedal or damper pedal 1530) as desired to help dampen the sound coming from vessel of idiophones 100/1000/1200/1400.

Referring now to FIG. 33, in various embodiments, such as an idiophone 800, top playable surface 830 has an aperture 840 and a butterfly valve 870 defined in playable surface 830. Aperture 840 allows liquid or fluid to be provided in vessel 810, and/or any second vessel or buoy 860 therein to be adjusted or moved. In various embodiments, valve 870 is rotatable to create a wavering or a tremolo effect on sound omitted from vessel 810. While valve 870 may be rotated in a variety of ways, in various examples of embodiments, the valve is coupled to a battery-operative mechanism useable to rotate the valve. A switch (e.g., provided near the buoy mechanism) may be used by a performer or player to power the mechanism on and off.

In various embodiments, the idiophone also includes a tilting mechanism. In various embodiments, the tilting mechanism can help tilt the idiophone to alter or vary the pitch and/or tone emitted from the one or more vessels included in the idiophone.

In various embodiments, the idiophone of the present disclosure may also include a pick-up device that may be used to capture since the sound or mechanical vibrations produced by the idiophone and convert them to an electrical signal that may be amplified to produce musical sounds through a loudspeaker, or recorded directly.

In various embodiments, idiophones of the present disclosure may also include a bubble mechanism and/or a blowing arm. For example, a bubble mechanism or blowing arm may be provided through an aperture defined in a hollowed out arm that helps move the second member relative to the first member. The idiophone may include an apparatus for introducing bubbles into the fluid retained therein. Such an apparatus may be used to produce a sound. It may also be used to help oxygenate the liquid, depending on the liquid being used (e.g., to prevent it from becoming stagnant).

As another example, the idiophone may include an apparatus to drop objects, additional fluid(s), etc., from above the fluid level to also produce a sound. Such idiophone(s) may also include an apparatus of mechanism for adjusting the fluid level to change and/or tune the sound produced by those bubbles, object(s) or fluid(s).

As utilized herein, the terms "approximately," "about," "substantially," and similar terms are intended to have a broad meaning in harmony with the common and accepted usage by those of ordinary skill in the art to which the subject matter of this disclosure pertains. It should be understood by those of skill in the art who review this disclosure that these terms are intended to allow a description of certain features described and claimed without restricting the scope of these features to the precise numerical ranges provided. Accordingly, these terms should be interpreted as indicating that insubstantial or inconsequential modifications or alterations of the subject matter described and claimed are considered to be within the scope of the invention as recited in the appended claims.

It should be noted that references to relative positions (e.g., "top" and "bottom") in this description are merely used to identify various elements as are oriented in the Figures. It should be recognized that the orientation of particular components may vary greatly depending on the application in which they are used.

For the purpose of this disclosure, the term "coupled" means the joining of two members directly or indirectly to one another. Such joining may be stationary in nature or moveable in nature. Such joining may be achieved with the two members or the two members and any additional intermediate members being integrally formed as a single unitary body with one another or with the two members or the two members and any additional intermediate members being attached to one another. Such joining may be permanent in nature or may be removable or releasable in nature.

It is also important to note that the construction and arrangement of the system, methods, and devices as shown in the various examples of embodiments is illustrative only. Although only a few embodiments have been described in detail in this disclosure, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter recited. For example, elements shown as integrally formed may be constructed of multiple parts or elements show as multiple parts may be integrally formed, the operation of the interfaces may be reversed or otherwise varied, the length or width of the structures and/or members or connector or other elements of the system may be varied, the nature or number of adjustment positions provided between the elements may be varied (e.g. by variations in the number of engagement slots or size of the engagement slots or type of engagement). The order or sequence of any process or method steps may be varied or re-sequenced according to alternative embodiments. Other substitutions, modifications, changes and omissions may be made in the design, operating conditions and arrangement of the various examples of embodiments without departing from the spirit or scope of the present inventions.

While this invention has been described in conjunction with the examples of embodiments outlined above, various alternatives, modifications, variations, improvements and/or substantial equivalents, whether known or that are or may be presently foreseen, may become apparent to those having at least ordinary skill in the art. Accordingly, the examples of embodiments of the invention, as set forth above, are intended to be illustrative, not limiting. Various changes may be made without departing from the spirit or scope of the invention. Therefore, the invention is intended to embrace all known or earlier developed alternatives, modifications, variations, improvements and/or substantial equivalents.

What is claimed is:

1. An instrument comprising:

a first vessel having a bottom section coupled to a sidewall to form a liquid receiving receptacle open at an upper end of the sidewall;

and a second member provided in the liquid receiving receptacle of the first vessel in a spaced nested relation to the first vessel;

whereby the first vessel or the second member make a sound of a first pitch or tone when struck, rubbed or vibrated;

whereby the second member is moveable relative to the first vessel to displace and/or replace liquid in the liquid receiving receptacle of the first vessel such that the first vessel or second member makes a sound of a second pitch or tone when struck, rubbed or vibrated as the liquid therein is displaced or replaced by movement of the second member relative to the first vessel.

2. The instrument of claim 1, whereby the second member is a vessel.

3. The instrument of claim 2, whereby the second member is a buoy.

4. The instrument of claim 2, whereby the second member has a bottom section coupled to a sidewall to form a liquid receiving receptacle open at an upper end of the sidewall of the second member.

5. The instrument of claim 4, further comprising a third member provided in the liquid receiving receptacle of the second vessel in a spaced nested relation to the first vessel.

6. The instrument of claim 5, whereby the second member or the third member make a sound of a first pitch or tone when struck, rubbed or vibrated; and whereby the second member is moveable relative to the third member to displace and/or replace liquid in the liquid receiving receptacle of the second member such that the second member or third member makes a sound of a second pitch or tone when struck, rubbed or vibrated as the liquid in the second member is displaced or replaced by movement of the second member relative to the third member.

7. The instrument of claim 6, further comprising a fourth member provided in the liquid receiving receptacle of the second vessel in a spaced nested relation to the first vessel.

8. The instrument of claim 7, whereby the fourth member makes a sound of a first pitch or tone when struck, rubbed or vibrated; and Whereby the second member is moveable relative to the fourth member to displace and/or replace liquid in the liquid receiving receptacle of the second member such that the second member, the third member or the fourth member makes a sound of a second pitch or tone when struck, rubbed or vibrated as the liquid in the second member is displaced or replaced by movement of the second member relative to the fourth member.

9. The instrument of claim 1, further comprising a playable surface partially spanning the liquid receiving receptacle at the upper end of the sidewall.

10. A method of playing an instrument, the method comprising:

moving a member provided in a liquid retained in a liquid receiving receptacle of a first vessel to displace and/or replace the liquid in the liquid receiving receptacle of the first vessel such that the first vessel makes sounds of different or varying pitches or tones when struck, rubbed or vibrated as the fluid is displaced or replaced in the first vessel; and whereby the member is a second vessel having a bottom section coupled to a sidewall to form a liquid receiving receptacle open at an upper end of the sidewall of the second vessel.

11. The method of playing an instrument of claim 10, whereby the member makes sounds of different or varying pitches or tones when struck, rubbed or vibrated as the fluid is displaced or replaced in the first vessel.

12. The method of playing an instrument of claim 10, whereby moving the second vessel also causes displacement of liquid in the liquid receiving receptacle of the second vessel to be displaced or replaced in the second vessel such that the second vessel makes sounds of different or varying pitches or tones when struck, rubbed or vibrated.

13. An instrument comprising:

a first vessel having a bottom section coupled to a sidewall to form a liquid receiving receptacle open at an upper end of the sidewall;

and a second member provided in the liquid receiving receptacle of the first vessel in a spaced nested relation to the first vessel;

whereby the second member is configured to create one or more electromagnetic fields to displace and/or replace magnetic ferrofluid in the liquid receiving receptacle of the first vessel such that the first vessel makes sounds of different or varying pitches or tones when struck, rubbed or vibrated as the magnetic ferrofluid therein is displaced or replaced.

* * * * *